US010822164B2

(12) United States Patent
Theodoroff et al.

(10) Patent No.: US 10,822,164 B2
(45) Date of Patent: Nov. 3, 2020

(54) RACK AND BAG FOR RECYCLING WASTE SHEET MATERIAL

(71) Applicant: Poly Wrap Recycling LLC, Sheyboygan, WI (US)

(72) Inventors: James P. Theodoroff, Sheboygan, WI (US); Jeffrey Haen, Cleveland, WI (US)

(73) Assignee: Poly Wrap Recycling, Inc., Sheboygan, WI (US)

( * ) Notice: Subject to any disclaimer, the term of this patent is extended or adjusted under 35 U.S.C. 154(b) by 302 days.

(21) Appl. No.: 15/627,151

(22) Filed: Jun. 19, 2017

(65) Prior Publication Data

US 2017/0362028 A1 Dec. 21, 2017

Related U.S. Application Data

(60) Provisional application No. 62/352,412, filed on Jun. 20, 2016.

(51) Int. Cl.
*B65F 1/14* (2006.01)

(52) U.S. Cl.
CPC ..... *B65F 1/1415* (2013.01); *B65F 2210/181* (2013.01); *B65F 2220/128* (2013.01);
(Continued)

(58) Field of Classification Search
CPC . B65F 1/1415; B65F 2210/181; B65D 33/007
(Continued)

(56) References Cited

U.S. PATENT DOCUMENTS 621,765 A * 3/1899 Buxton ..... B65B 67/12 248/99
1,005,956 A * 10/1911 Gibbins ..... B65B 67/12 248/97

(Continued)

FOREIGN PATENT DOCUMENTS

DE 4133503 * 4/1992 ..... B65F 1/1415
GB 2177996 A * 2/1987 ..... B65B 67/12

OTHER PUBLICATIONS

Design U.S. Appl. No. 29/605,641, Application date: May 28, 2017, Applicant: Theodoroff, et al., Title: Portable Rack Device.

(Continued)

*Primary Examiner* — Michael Safavi
(74) *Attorney, Agent, or Firm* — Thomas D. Wilhelm; Stephen C. Jensen; Northwind IP Law, S.C.

(57) ABSTRACT

Specially-designed rack and plastic bag, and methods of use. The bag is mounted on the rack with a lower portion of the bag disposed inwardly and downwardly of the top of the rack, and an upper portion of the bag disposed outwardly and downwardly of the top of the rack. Workers place thin-section waste material into the bag. When the bag is full, the bag is replaced with an empty bag. The bag has holes, which enable air to escape through bag side walls while the bag is being compressed in a baler. Because air escapes through the side walls, more of the air can be removed for a given baler compaction force thereby the resulting bale weighs about 10% to about 25%, or greater, more than a bale made with the same materials and the same baler conditions, without use of the rack and bags of the invention.

9 Claims, 13 Drawing Sheets

(52) U.S. Cl.
CPC . *B65F 2250/114* (2013.01); *B65F 2250/1143* (2013.01); *B65F 2250/1146* (2013.01)

(58) Field of Classification Search
USPC ..... 248/97, 99, 100, 101; 211/85.15; 224/925; D34/6; 383/117, 118, 102
See application file for complete search history.

(56) References Cited

U.S. PATENT DOCUMENTS 1,145,297 A * 7/1915 Erickson et al. ..... B65B 67/12 248/97
1,554,034 A * 9/1925 Richie ..... B62B 1/12 280/654
1,918,793 A * 7/1933 Baker ..... D06F 95/006 383/103
2,132,734 A * 10/1938 Hart ..... D06F 95/006 383/102
2,263,787 A * 11/1941 Safferson ..... D04B 21/10 66/170
2,942,823 A * 6/1960 Chapman ..... A01G 9/0291 248/97
3,095,172 A * 6/1963 Dwyer ..... B65B 67/12 248/97
3,161,391 A * 12/1964 Bahnsen ..... D06F 95/004 248/99
3,603,542 A * 9/1971 Grille ..... B65B 67/12 248/98
4,175,602 A * 11/1979 Cavalaris ..... A45C 13/34 141/390
4,304,378 A * 12/1981 Briggs ..... B65B 67/1255 248/150
4,623,111 A * 11/1986 Prader ..... B65B 67/1227 220/495.01
4,638,968 A * 1/1987 Auten ..... B65B 67/12 248/100
4,667,912 A * 5/1987 DeVilbiss ..... B65B 67/1205 248/150
4,690,357 A * 9/1987 Webster ..... B65B 67/12 248/97
4,705,246 A * 11/1987 Wolf ..... B65B 67/12 141/390
4,957,252 A * 9/1990 Watkins ..... B65B 67/1222 248/100
4,979,833 A * 12/1990 Cook ..... A45C 3/00 383/109
5,169,101 A * 12/1992 Wenzel ..... B65B 67/1227 248/95
5,183,226 A * 2/1993 Brooks ..... B65B 67/1205 248/97
5,213,291 A * 5/1993 Wiebe ..... B65B 67/1227 248/97
5,246,110 A * 9/1993 Greyvenstein ..... B65F 1/0006 206/390
5,263,672 A * 11/1993 He ..... B65B 67/1205 248/97
D389,632 S * 1/1998 Reddin ..... D34/6
D428,544 S * 7/2000 Moffitt ..... D34/5
6,092,767 A * 7/2000 Schrager ..... B65F 1/1468 248/95
D436,706 S * 1/2001 Clinton ..... D34/6
6,334,593 B2 * 1/2002 Inoue ..... B65B 67/1205 248/95
6,398,410 B1 * 6/2002 Guerra ..... D06F 95/006 383/117
D461,986 S * 8/2002 Talley ..... D6/552
6,446,919 B1 * 9/2002 Tsui ..... B65B 67/1205 248/100
6,467,735 B1 * 10/2002 Clinton ..... B65B 67/12 248/153
6,543,732 B1 * 4/2003 Yuan ..... B65B 67/1205 248/101
7,967,153 B2 * 6/2011 Simhaee ..... B65B 67/1227 211/163
D665,550 S * 8/2012 Connor ..... D34/5
8,381,978 B2 * 2/2013 Matsuhisa ..... A47F 9/042 235/435
8,684,323 B2 * 4/2014 McConnell ..... B65B 67/1227 220/495.08
8,857,772 B1 * 10/2014 Weldon ..... B65B 67/1238 248/95
D827,448 S 9/2018 Theodoroff et al.
D838,127 S 1/2019 Theodoroff et al.
2003/0108254 A1 * 6/2003 Watkins ..... D06F 95/004 383/23
2004/0197031 A1 * 10/2004 Torick ..... B65B 67/12 383/102
2005/0242248 A1 * 11/2005 Ryan ..... D06F 95/006 248/95
2007/0045484 A1 * 3/2007 Tombazzi ..... B65B 67/1222 248/99
2007/0157424 A1 * 7/2007 Mottahedeh ..... A01G 20/47 15/405
2007/0181753 A1 * 8/2007 Herlands ..... B65B 67/12 248/99
2012/0325984 A1 * 12/2012 Moynihan ..... B65B 31/048 248/98
2013/0001377 A1 * 1/2013 Reiss ..... B65B 67/1205 248/97
2015/0048039 A1 * 2/2015 Laitila ..... A47F 13/085 211/85.15

OTHER PUBLICATIONS

Design U.S. Appl. No. 29/605,872, Application date: May 31, 2017, Applicant: Theodoroff, et al., Title: Vented Plastic Bag.

* cited by examiner

RACK AND BAG FOR RECYCLING WASTE SHEET MATERIAL

BACKGROUND OF THE INVENTION

This invention relates to the management of waste portions of recyclable thin-section materials, such as plastic films, paper, banding, and other thin-section e.g. sheet materials. While the description herein focuses largely on plastic film waste, this invention can be applied to many thin-section waste materials with similar benefits being achieved.

The instant invention provides novel methods, apparatus, and systems for placement, compaction, and transportation of thin-section recyclable materials. The invention overcomes, or at least attenuates, limitations in current common industry practices regarding recycling of thin-section recyclable materials such as plastic film, paper, laminates, plastic banding, and the like.

Typical recyclable plastic materials which can be recycled using the apparatus, systems, and methods of the invention are, without limitation, e.g. low density polyethylene, also known as LDPE, various packaging films and sheets, and other thin-section plastics.

Traditionally, waste thin-section plastic film such as low density polyethylene (LOPE) has been sent to landfill, in 2013, the United States generated more than 33 million tons of plastic film waste of which only about 9% was recycled. A large portion of the remaining approximately 91% of this waste plastic film material is believed to have gone into landfills.

More recent thinking is that recycling is better for the environment. Recycling of plastic film is typically viewed as labor and time intensive, and therefore costly, and potentially not cost effective compared to landfilling, even though landfills typically charge tipping fees to receive such materials. One of the problems associated with recycling thin-section plastic films is that conventional recycling methods initially include a large volume of air in the space occupied by the waste film when the waste film is first retrieved and placed in a receptacle. As a result, the bulk density of the material being recycled is very low in the receptacle as initially placed. Low bulk density leads to high storage volume, high transportation costs, and high corresponding environmental impact per pound/ton of waste material. So there is an economic incentive to increase the bulk density as early as possible in the processing of such waste material, irrespective of whether the film is to be recycled or is to be sent to landfill. Relatively greater densities are desired so long as such densities can be achieved economically.

As an initial matter, a waste producer must decide whether to recycle the waste material or send the waste material to landfill, if the material is recycled, there is a cost associated with the recycling process, if the material is sent to the landfill, there are still the costs associated with typically increasing the bulk density of the material, as well as trucking and tipping fees.

Any costs associated with baling waste plastic film must be balanced against the downstream cost savings associated with e.g. lower transportation cost tor baled material versus non-baled material or material baled with a relatively tower density.

If the waste plastic film is to be baled and recycled, a further consideration is the relatively greater sale value of baled material, given the relationship between value per ton and bulk density which is achieved in the baler.

Accordingly, retrieved waste film material is commonly compacted and baled, which increases the bulk density. But the thin-section waste film material traps small amounts of air within the so-compacted bulk mass of the material, limiting the bulk density of the so-compacted material to substantially less than the mass density of the polymer or polymers of which the film is composed.

The bulk density of conventionally-baled plastic film waste is such that a truckload of such baled film reaches the volume capacity of the truck before the weight limit/capacity of the truck is reached. Thus, to the extent bulk density of such compacted and baled waste film materials could be economically increased, the economic attractiveness of recycling such waste plastic film would be increased.

Currently, collection of e.g. recyclable plastic film in industrial settings is labor intensive Conventional practices with respect to recycling plastic film typically include manually retrieving the waste film and loosely placing the film in a large container such as a Gaylord, a 55 gallon drum, or other bulk container for temporary storage prior to compaction/baling.

One significant limitation of current procedures for recycling such materials, for example plastic film, is the repetitive movements required of a worker to remove the plastic film or other thin-section waste from the container into which the waste is initially placed, and to place that waste material into a compactor, for example a baler.

As referred to herein, a Gaylord is a large open-top bulk-material container such as a corrugated box, a wire cage, a plastic bin, or a cart. The container has the length and width of a typical industrial wood skid about 40 inches long and 48 inches wide. Such container is typically placed on the top of a such skid. Thus, the container generally overlies the entire length and width of the skid, and the sides of the box are coextensive with imaginary vertical planes which extend up from the sides of the skid.

The above mentioned loose placement of the film waste in the bulk container includes a substantial volume of air in the bulk container, which directs the economic cost of transporting such recyclable materials. Current such recycling practices use workers to manually retrieve the plastic waste from the location where the waste is generated, and to manually place the waste material in the bulk container. Such manual labor includes the worker repeatedly lifting the film, twisting his/her body, and placing the waste film in the bulk container which, collectively, is accompanied by potential for worker injury. Any such worker injury translates into lost worker productivity and related health care and associated economic costs for employers. Typically, the worker continues to add waste film to the bulk container until no more film can be added without some of the film falling out of the bulk container. The bulk container is then moved, e.g. by a fork lift to a sits for pick-up by a truck which hauls the respective container away, such as to a recycling center, for processing.

In facilities generating more than a ton of thin-section plastic waste in a given month, the plastic is commonly compacted at the waste-generating facility in which case the forklift driver takes the filled bulk container to a compactor/baler. Once compacted, the compacted material is then tied with ties or wrapped with overlying layers of plastic or otherwise confined, thus to compress a mass of the waste film, and to retain the compressed waste film in the form of a bale of the compressed/compacted waste material. Such compressing/compacting and baling substantially increases the bulk density of the waste material, thus decreasing the subsequent downstream cost of disposing of the waste material if the material is not to be recycled, and increasing the economic value of the waste material if the waste material is to be recycled.

Such baling typically, again, involves manual labor, where a worker manually removes the waste plastic film from the bulk container (e.g. Gaylord or other container) and places the removed material into a baler/compactor.

In the process of moving the waste material from bulk containers to the baler, the worker bends, lifts, and twists his/her body many times in order to move enough of the waste material from enough bulk containers to the baler, to create a bale. Such bending, lift, and twisting movements, again, give rise to known potential for repetitive movement injuries to the worker, along with respective loss of social goodwill, and economic cost, to the employer.

Disadvantages in current thin-section waste material recycling practices include the number of trips from the site of waste generation to a bulk container, the physical demand on workers, including frequency and severity of worker injuries, the small mass density of the waste material placed in bulk containers, the number of times bulk containers need to be moved to a baler tor unloading, the limited mass of the waste material in each bale so produced, the corresponding limited economic value per bale of baled plastic film, the amount of the environmental impact per bale of baled plastic film, and the relatively smaller mass, and corresponding limited economic value, of baled waste plastic film per truckload delivered to a recycling center.

The above items of inefficiency in conventional practices relating to thin-section waste material recycling discourage the collection and recycling of thin-section waste material.

Accordingly, it would be desirable to provide improved apparatus, systems, and methods which encourage recycling of thin-section materials.

It would also be desirable to provide improved apparatus, systems, and methods which encourage recycling of waste plastic films.

It would further be desirable to provide apparatus, systems, and methods which reduce the environmental impact of such waste materials on landfills.

It would further be desirable to provide improvements which reduce the physical demands on workers to bend, lift, and twist while loading or unloading a container containing a low-density charge of such thin-section waste material.

It would also be desirable to provide improvements which reduce transportation costs associated with recycling waste plastic film.

It would also be desirable to provide improvements which increase the density, and therefore, the economic value of baled plastic film waste.

These and other improvements are provided by the instant invention.

SUMMARY OF THE INVENTION

The present invention provides a specially-designed rack, and a specially-designed plastic bag, and methods of use of such rack and bag. With the bag mounted on the rack, workers place e.g. recyclable plastic films or other thin-section material into the bag at the site where such waste material is generated. With the bag mounted on the rack, waste material can be modestly compressed by a worker as the worker is placing the waste material into the bag. When the bag is full of recyclable material, the filled bag is removed from the rack and set aside, optionally placed in a Gaylord or other bulk container larger than the bag, and a new/empty bag is mounted on the rack.

A bag of the invention has holes specifically designed and strategically located about the surface area of the bag, to enable air to escape through the side walls of the bag while the bag is being compressed in the baler. Because the air can easily escape from the bag, through the holes in the bag side walls during baling, a greater fraction of the air can be removed from the bag for a given compaction force whereby a bale of such e.g. plastic film, has been found to contain about 10% to about 25%, or more, additional weight/mass of the film or other thin-section waste material than a traditional bale made with the same materials and the same baler conditions, without use of bags of the invention.

When a desired number of such bags have been filled with recyclable e.g. plastic material, the filled plastic bags are moved to a baler, and baled.

The rack structure of the invention, with the bag of the invention mounted thereon, replaces bulk containers as the initial receptacle for the waste e.g. plastic film, and reduces the amount of manual labor associated with such bulk containers, especially the labor involved in removing the waste material from the bulk container.

Bags of the invention are conveniently, though not necessarily, sized and configured such that three such bags, filled at an exemplary rack of the invention, fit into a single conventional bulk Gaylord-type container. The filled weight in the bulk container, using filled hags of the invention, is about 3 times the weight in a respective bulk container which has been filled using traditional techniques for manually filling the container with loosely-placed waste plastic film. Using the hags and racks of the invention thus reduces the number of times bulk containers need to be transported from the waste generation site, to a respective baler, truck, or storage location, and increases the weight/mass, and thus the bulk density, of material delivered with, each bulk container delivery.

In a first family of embodiments, the invention comprehends, in combination, a rack adapted and configured to hold a bag, and a bag adapted and configured to be held on the rack, while waste material is being placed in the bag, the rack comprising a base section defining a bottom of the rack, the bottom of the rack being adapted to interface with an underlying support, the base section further comprising a base section length, front-to-back, and a base-section width, side-to-side, perpendicular to the base section length, an upper section adapted to be disposed above the base section, the upper section defining a top of the rack, the upper section having an upper section length, front-to-back, an upper section width, side-to-side, perpendicular to the upper section length, and an upper section circumference, the upper section circumference extending across any open spaces between next adjacent ends of the upper section at the top of the rack, at least one of the base section length or the base section width being greater than the respective upper section length or upper section width, at least a first log adapted to extend from the base section to the upper section and to support the upper section from the base section, the bag having a receptacle size corresponding to at least a 40-gallon US capacity when the bag is installed on the rack, the bag having a top edge, a bottom edge, and a generally continuous side wall extending from the top edge to the bottom edge, a length of the bag generally extending along the side wall from the top edge to the bottom edge, the bag being closed at or adjacent the bottom edge of the bag, the bag being open about a full circumference of the bag at the top edge, thereby to define the bag as an open-top, closed-bottom receptacle adapted and configured to receive thin-section sheet material when mounted on the rack, an array of holes being distributed about the circumference of the bag, and extending along at least sixty percent of the length of the bag, the holes being located and sized so as to provide a hole open area, in the hole array, about the circumference and along the length of the bag, effective to facilitate escape of air from the bag during compression of the bag when the bag is filled with waste sheet material.

In some embodiments, the bag is mounted on the rack with a lower portion of the bag extending inwardly of, and downwardly from, the upper section of the rack and with an upper portion of the bag extending outwardly and downwardly over the upper section of the rack.

In some embodiments, the bottom of the bag is at or slightly above the bottom of the rack.

In some embodiments, at least one of a friction element or a point restrictor is mounted on the rack at a location where a weight in the bottom of the bag applies a stress in the bag at the top of the rack.

In some embodiments, the combination further comprises a friction element mounted to the rack at an elbow which extends from the at least one leg onto an arm which defines at least a portion of the top of the rack.

In some embodiments, the friction element composes a rubber or plastic sleeve.

In some embodiments, the combination further comprises an array of point restrictors mounted to the rack at a location where a weight in the bottom of the bag applies a stress in the bag at the top of the rack.

In some embodiments, the array of holes defines a hole fraction of 0.05% to 1%, optionally 0.07% to 0.5%, optionally 0.07% to 0.25%, of the surface area of the sidewall of the bag.

In some embodiments, the holes in the array of holes are spaced apart by an average of at least 3 inches, optionally at least 4 inches.

In some embodiments, an average open area of the holes in the array corresponds to the area of around hole having a diameter of at least 0.18 inch, optionally about 0.38 inch.

In a second family of embodiments the invention comprehends a plastic bag adapted and configured to be mounted to a rack wherein the rack has a base section defining a bottom of the rack, the base section being adapted to interface with an underlying support, an upper section of the rack being adapted to be disposed above the base section, the upper section defining a top of the rack, at least a first leg of the rack being adapted to extend from the base section to the upper section and to support the upper section from the base section, the bag having a top edge, a bottom edge, and a generally continuous side wall extending from the top edge to the bottom edge, a length of the bag generally extending at least 50 inches from the top edge to the bottom edge, the side wall having a thickness of about 1.25 mils to about 10 mils, the bag being closed at or adjacent the bottom edge of the bag, the bag having a fully open circumference of at least 64 inches at the top edge of the bag, thereby to define the bag as an open-top, closed-bottom receptacle adapted and configured to receive thin-section sheet material tossed loosely thereinto, when the bag is mounted to the rack, the bag having an array of holes distributed about the circumference of the bag, the array of holes extending along at least, sixty percent of the length of the bag, the holes being located and sized so as to provide average hole open area, in the hole array, about the circumference and along the length of the bag, when said the is filled with waste sheet material, and with the bag having been closed at the open top, effective to facilitate escape of air from the bag through the side wall during compression of the bag in a baler, while retaining the waste sheet material in the bag.

In a third family of embodiments, the invention comprehends a rack adapted and configured to receive and hold a bag while waste material is being placed in the bag, the rack comprising a base section defining a bottom of the rack, the bottom of the rack being adapted to interface with an underlying support the base section further comprising a base section length, front-to-back, and a base section width, side-to-side, perpendicular to the base section length, an upper section adapted to be disposed above the base section, the upper section defining a top of the rack, the upper section having at least one arm defining an upper section circumference, the upper section circumference extending across any open spaces between next adjacent ends of the upper section at the top of the rack, at least one of the base section length or the base section width being greater then the respective upper section length or upper-section width, at least a first leg adapted to extend from the base section to the upper section and to support the upper section from the base section, and at least one of a friction element or a point restrictor being mounted on the rack at a location where a weight in the bottom of the bag applies a stress in the bag at the top of the rack.

In some embodiments the rack has a height between the top of the rack and the bottom of the rack, further comprising a bag line marker on the first leg, the bag line marker being spaced from the lop of the rack by a distance at least 10 percent as great as the height of the rack.

In some embodiments, a friction element is mounted to the rack at an elbow which extends from the at least one arm which defines at least a portion of the top of the rack, onto the at least one leg, the elbow having a radius of about 2.5 inches.

In some embodiments, the at least one leg comprises first and second legs, the first and second legs extending from the base section to the upper section, the legs being angled toward each other from the base section toward the upper section such that relatively ripper portions of the legs are closer together than relatively lower portions of the legs.

In a fourth family of embodiments, the invention comprehends a rack adapted and configured to receive and hold a bag while waste material is being placed in the bag, the rack comprising a base section defining a bottom of the rack, the bottom of the rack being adapted to interface with an underlying support, the base section further comprising a base section length, front-to-back, and a base section width, side-to-side, perpendicular to the base section length, an upper section adapted to be disposed above the base section, the upper section defining a top of the rack, the upper section having an upper section length, front-to-back, an upper section width, side-to-side perpendicular to the upper section length, and one or more upper section arms defining an upper section circumference, the upper section circumference extending across any open spaces between next adjacent ends of the upper section arms at the top of the rack, at least one of the base section length or the base section width being greater than the respective upper section length or upper section width, at least a first leg adapted to extend from the base section to the upper section and to support the upper section from the base section, and a rack height extending between the bottom of the rack and the top of the rack, and a bag line marker on the first leg, the bag line marker being spaced from the top of the rack by a distance at least 10 percent as great as the height of the rack.

In some embodiments, the bag line marker on the first leg is spaced from the top of the rack by a distance at least 20 percent as great as the height of the rack.

In a fifth family of embodiments, the invention comprehends a method of processing thin-section waste material, comprising providing a rack, the rack having a base section defining a bottom of the rack, adapted to interface with an underlying support, an upper section disposed above the base section and defining a top of the rack, the upper section having one or more arms defining a circumference, the upper section circumference extending across any open spaces between next adjacent ends of the arms, at least a first leg extending from the base section to the upper section and supporting the upper section from the base section; mounting, on the rack, a bag having a top edge, a bottom edge, and a generally continuous side wall extending from the top edge to the bottom edge, the bag having a closed bottom and an open top, and an array of holes distributed about the circumference of the bag and extending along the length of the bag, the holes being located and sized so as to facilitate escape of air from the bag during compression of the bag when the bag is filled with thin-section waste material, a relatively lower portion of the bag, when so mounted on the rack, being disposed inwardly of the circumference of the upper section of the rack, a relatively upper portion of the bag extending outwardly over, and downwardly from, the arms of the upper section; placing a desired quantity of thin-section waste sheet material in the bag; closing the top of the bag, thereby preventing such thin-section sheet material from leaving the bag.

In some embodiments the method further comprises compressing the bag, containing such thin-section waste material, in a baler.

In some embodiments the method comprises compressing multiple such bags, containing such thin-section sheet material, in such baler thereby obtaining a bale having a weight at least 10 percent greater than a weight of a bale of the same thin-section waste sheet material baled by placing loose such material in the same such baler without use of such bag.

In some embodiments, the bottom of the bag is disposed at or slightly above the bottom of the rack when the sheet material is first being placed in the bag.

In some embodiments, the method further comprises providing a such rack having at least one of a friction element or a point restrictor mounted on the rack at a location where a weight in the bottom of the bap applies a stress in the bag at the top of the rack.

In some embodiments, the method further comprises providing such rack having a friction element mounted to the rack at a rack elbow, which rack elbow extends from the at least one leg onto an arm which defines at least a portion of the top of the rack.

In some embodiments, the method further comprises providing such rack having one or more point restrictors mounted to the rack at a location where a weight in the bottom of the bag applies a stress in the bag at the top of the rack.

In some embodiments, the method further comprises providing such bag wherein the array of holes defines a hole fraction of 0.05% to 1% of a surface arcs of the sidewall of the bag.

In some embodiments, the method comprises providing such bag wherein the holes in the array of holes are spaced apart by an average of at least 3 inches.

In some embodiments, the method comprises providing such bag wherein an average open area of the holes in the array corresponds to the area of a round hole having a diameter of 0.38 inch.

In some embodiments, the method comprises providing such rack having a bag line marker disposed on the first leg, and spaced downwardly from the top of the rack.

BRIEF DESCRIPTION OF THE DRAWINGS

FIGS. 1 and 4.

FIGS. 17-19 are cross-sections of textured friction strips which can be employed at the top of the rack in place of the friction sleeve of FIGS. 13-14 or the friction elements of FIG. 15.

Figure 1:
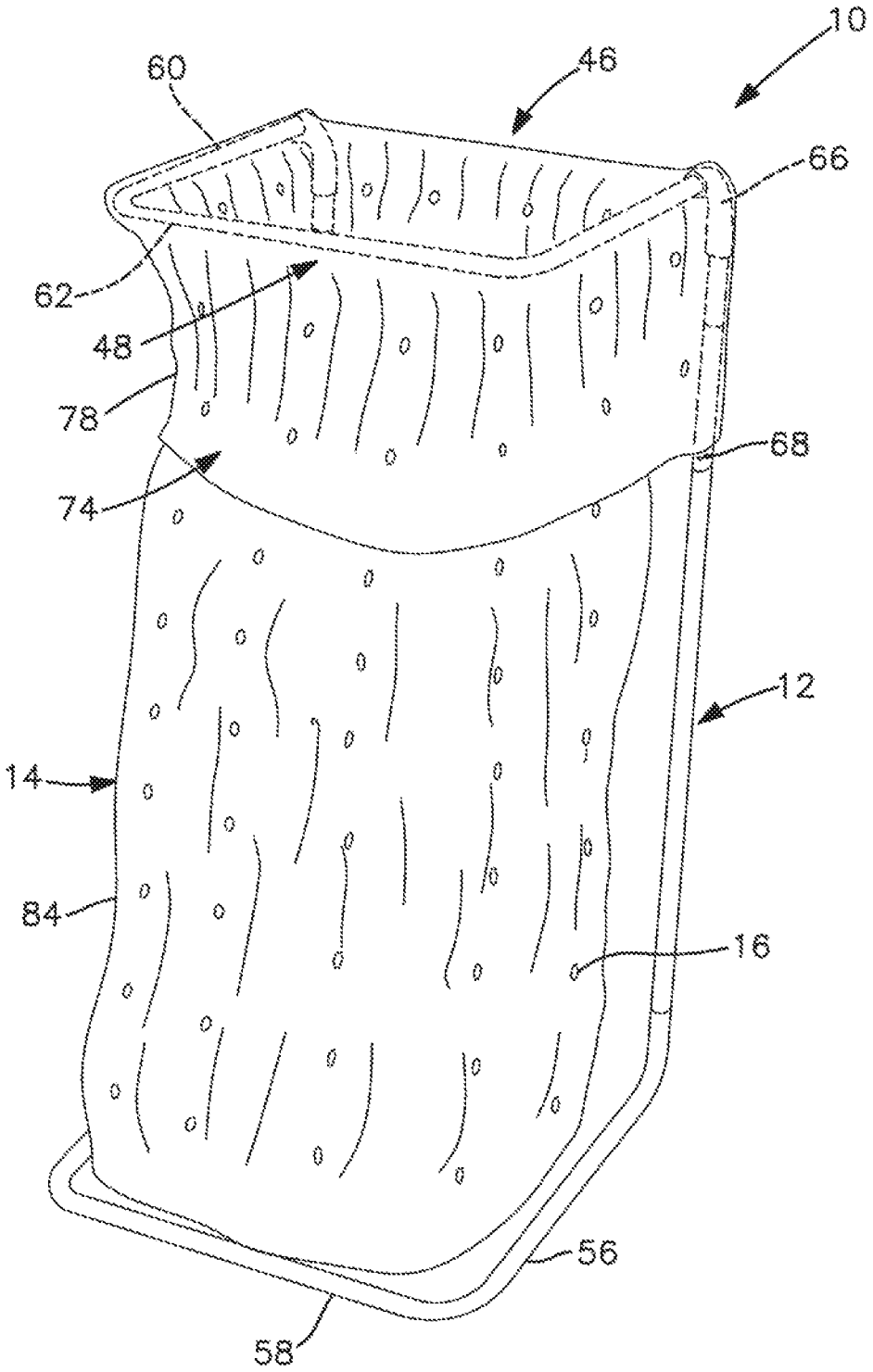
FIG. 1 shows a pictorial view, from the rear of the rack, with the bag fully installed on the rack.

The invention is not limited in its application to the details of construction, or in the arrangement of the components, or in the specific methods set forth in the following description or illustrated in the drawings. The invention is capable of other embodiments or of being practiced or carried out in ether various ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

Referring to FIG. 1, recycling system 10 includes a rack 12 and a bag 14. A matrix of holes 18 extend through the bag sidewalls.

Figure 2:
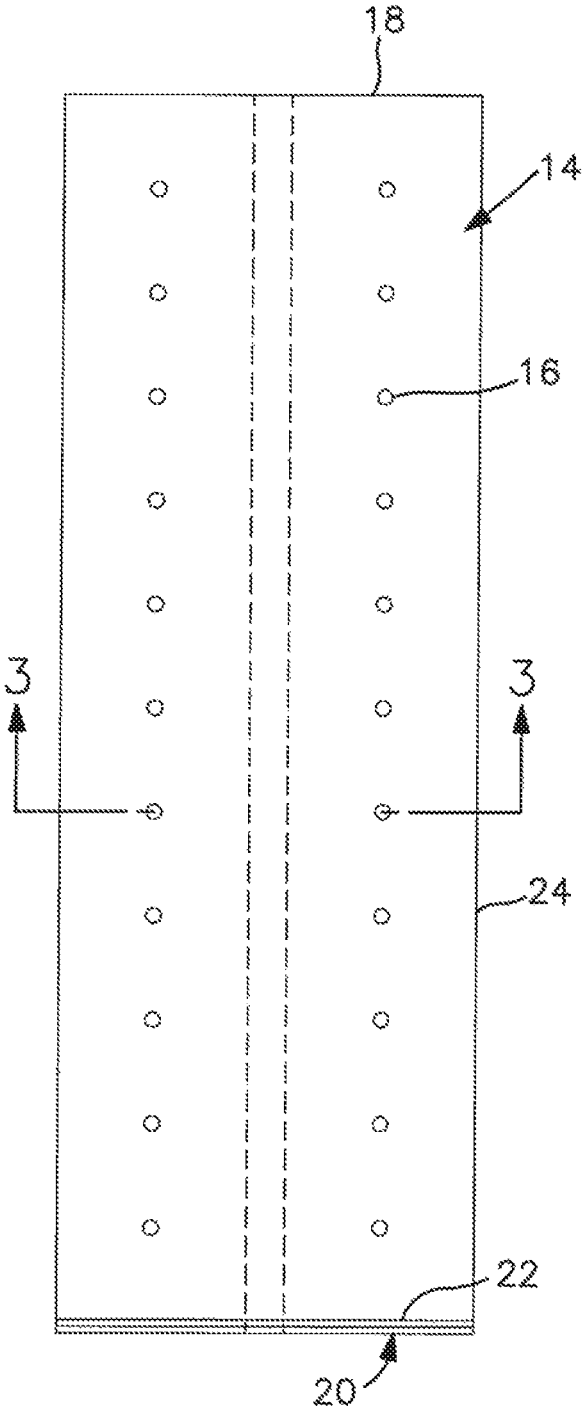
FIG. 2 is a plan view of a bag of the invention as folded at the Mm holes are being formed in the bag material.

Referring now to FIG. 2, bag 14 has a bag top 18 and a bag bottom 20. One or more seals 22 extend across the bag bottom adjacent the bottom edge of the bag, closing off the full width of the bottom of the bag.

Figure 3:
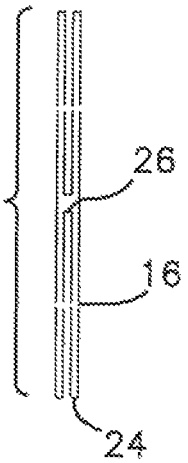
FIG. 3 is a cross-section of the bag of FIG. 2, taken at 3-3 of FIG. 2, and showing the folds in the bag, as well as the holes as aligned when the holes are formed.

FIGS. 2 and 3 show the bag folded longitudinally along fold lines 24 at the outer edges of the bag configuration and fold lines 28 internal to the bag configuration. Holes 16 are formed through the various layers of the bag, such as by one or more punches, while the bag is folded as in FIGS. 2 and 3.

Rack 12 as illustrated is formed using hollow round steel tubing. Solid rod material can be used in place of tubing. Also, the cross-section configuration of the rack material can be other than round, such as square, rectangular, oval, or the like.

Figure 4:
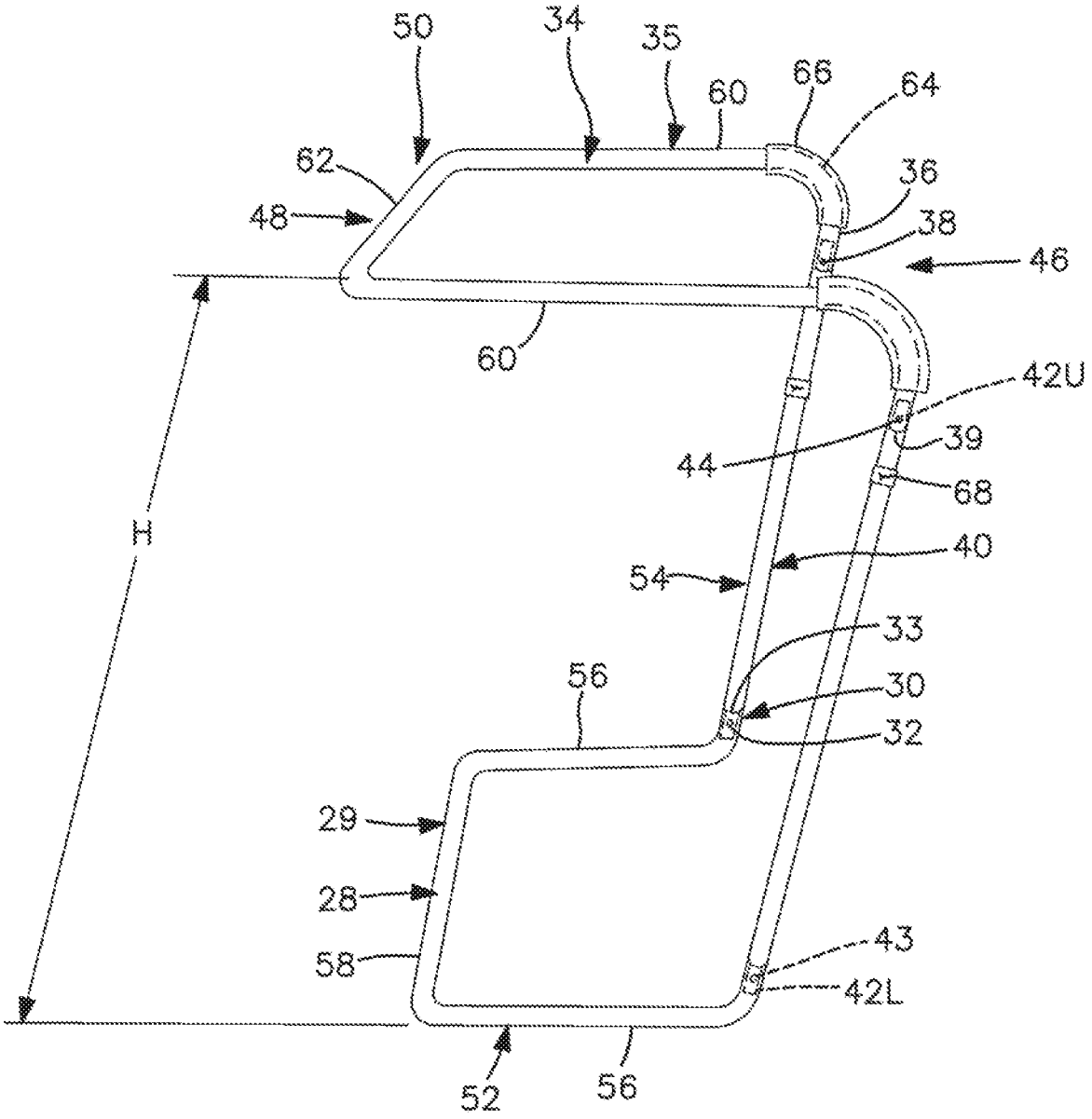
FIG. 4 shows a side pictorial view of a first embodiment of racks of the invention, configured to receive bags of the invention.

Referring now to FIGS. 1 and 4, rack 12 has a base section 28. Base section 28 includes a generally planar bottom portion 29 adapted to interface with a flat floor or other underlying generally flat surface Upstanding leg leads 30 extend upwardly from first and second ends of bottom portion 29. Holes 32 extend through leg leads 30 proximate upper ends 33 of leg leads 30.

Rack 12 further has an upper section 34. Upper section 34 includes a top portion 35 which extends generally parallel to bottom portion 29. Upper section 34 includes downwardly depending leg leads 38 extending downwardly form third and fourth ends of top portion 35. Holes 38 extend through leg leads 38 proximate lower ends 39 of leg leads 36.

On each side of the rack, log elements 40 extend between the respective lower leg leads 30 and upper leg leads 36. Each of leg elements 40 has an upper constriction 42U and a lower constriction 42L. Such constrictions are reduced-diameter lengths of the respective leg elements. Cross-sections of leg constrictions 42U and 42L are sized so as to fit snugly into the ends 33, 39 of leg leads 30, 38. Holes 43 extend generally horizontally through the respective leg constrictions 42U, 42L near respective ends of the corresponding constrictions.

With leg constrictions 42U, 42L fully inserted into the respective leg leads 30, 36, holes 43 in the leg constrictions are aligned with holes 32, 38 in the respective leg leads. Spring-loaded pins 44 inside the leg constrictions extend through holes 43 in the leg constrictions and thence through respective holes 32, 38 in the respective leg leads.

Rack 12 has a rack front 48 which typically faces toward a worker as the worker is loading a bag mounted on such rack as illustrated in FIG. 1. Rack 12 further has a rack rear 48 typically facing away from such worker, a rack top 50, and a rack bottom 52. Rack legs 54 extend between the rack top and the rack bottom, and include downwardly-extending portions of upper and lower leg leads 38 and upwardly-extending portions of lower leg leads 30.

Rack bottom 52 has opposing left and right side feet 56 and a rack rear foot 58 extending between the side feet. Rack top 50 has opposing left and right side arms 80 and a rear arm 62 extending between the side arms. Rack elbows 64 extend between side arms 60 and respective downwardly-extending legs 54, and connect the respective side arms with the corresponding legs.

Pins 44 in the leg constrictions and the corresponding leg leads stabilize the leg constrictions, and thus the leg elements, in the upper and lower leg leads, thus fixing the lengths of the legs, and correspondingly the height "H" of the rack, between the bottom 52 of the rack and the top 50 of the rack.

Structures and devices other than spring pins 44 and constrictions 42U, 42L can be used to removably or permanently secure leg elements 40 to base section 30 and upper section 34 in the process of assembling rack 12.

Sleeves 66, described in more detail hereinafter, are mounted to the rack at elbows 64, and extend generally from the top of the rack at side arms 60 to generally the top of the vertically downwardly-extending portions of legs 54. Sleeves 66 generally need not extend as far down as the ends 39 of upper leg leads 38.

A bag line marker 68 is positioned on each leg element, thus on each leg, well below the top of the rack. The bag line can be as simple as a line marking extending generally horizontally about at least a portion of the circumference of the leg. Typically, bag line marker 63 is a sticker or label which is adhesively mounted on the respective leg 54.

In an exemplary such rack, the rack height "H" is 53 inches from the bottom of the rack to the top of the rack, and bag line 68 is about 15 inches below the top of the rack. With the top of the bag folded down to the bag line as illustrated in FIGS. 1 and 8, the bottom of the bag generally should be able to reach to the underlying floor or other surface.

Figure 5:
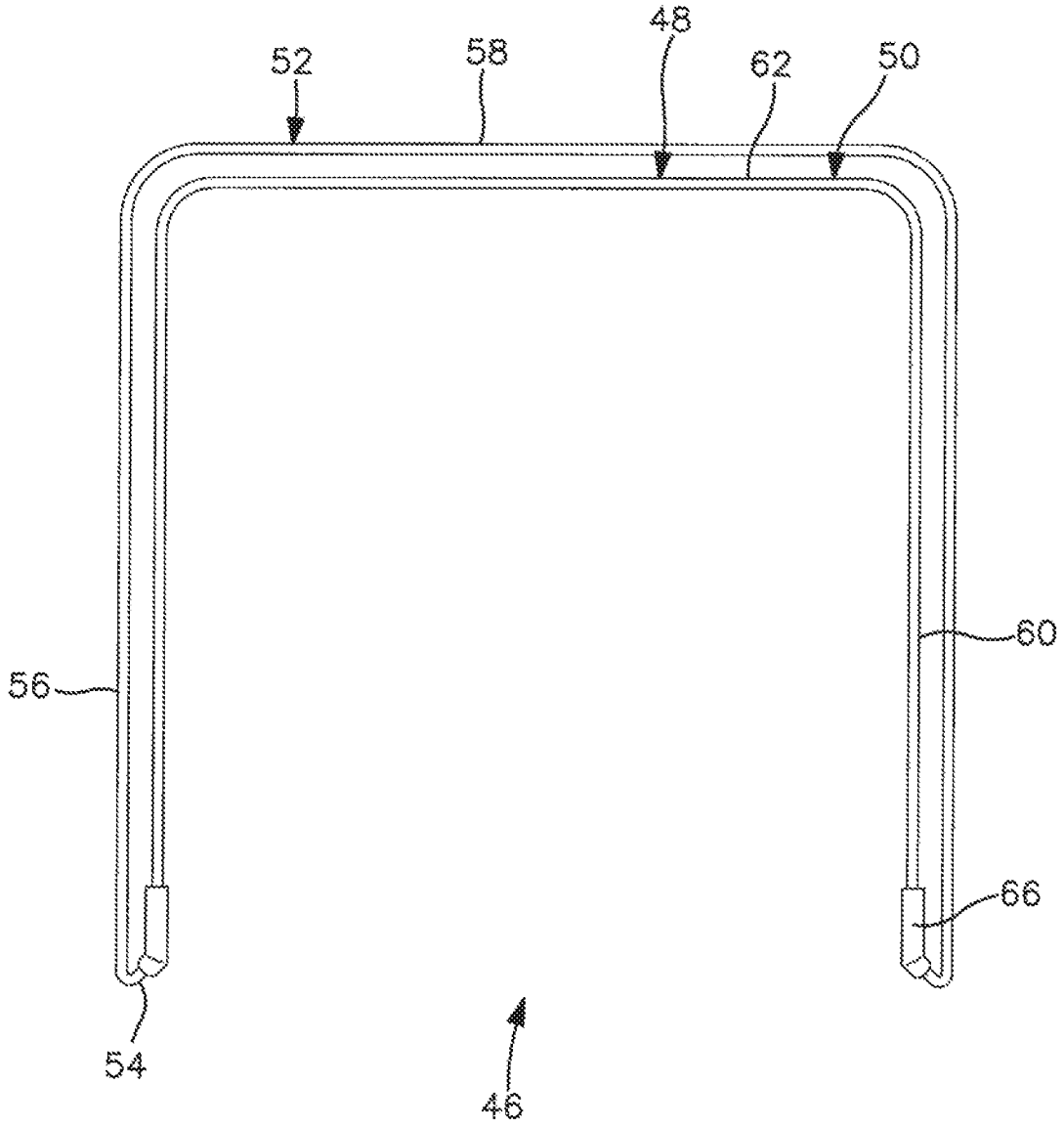
FIG. 5 is a top/plan view of the rack illustrated in FIG. 4.
Figure 6:
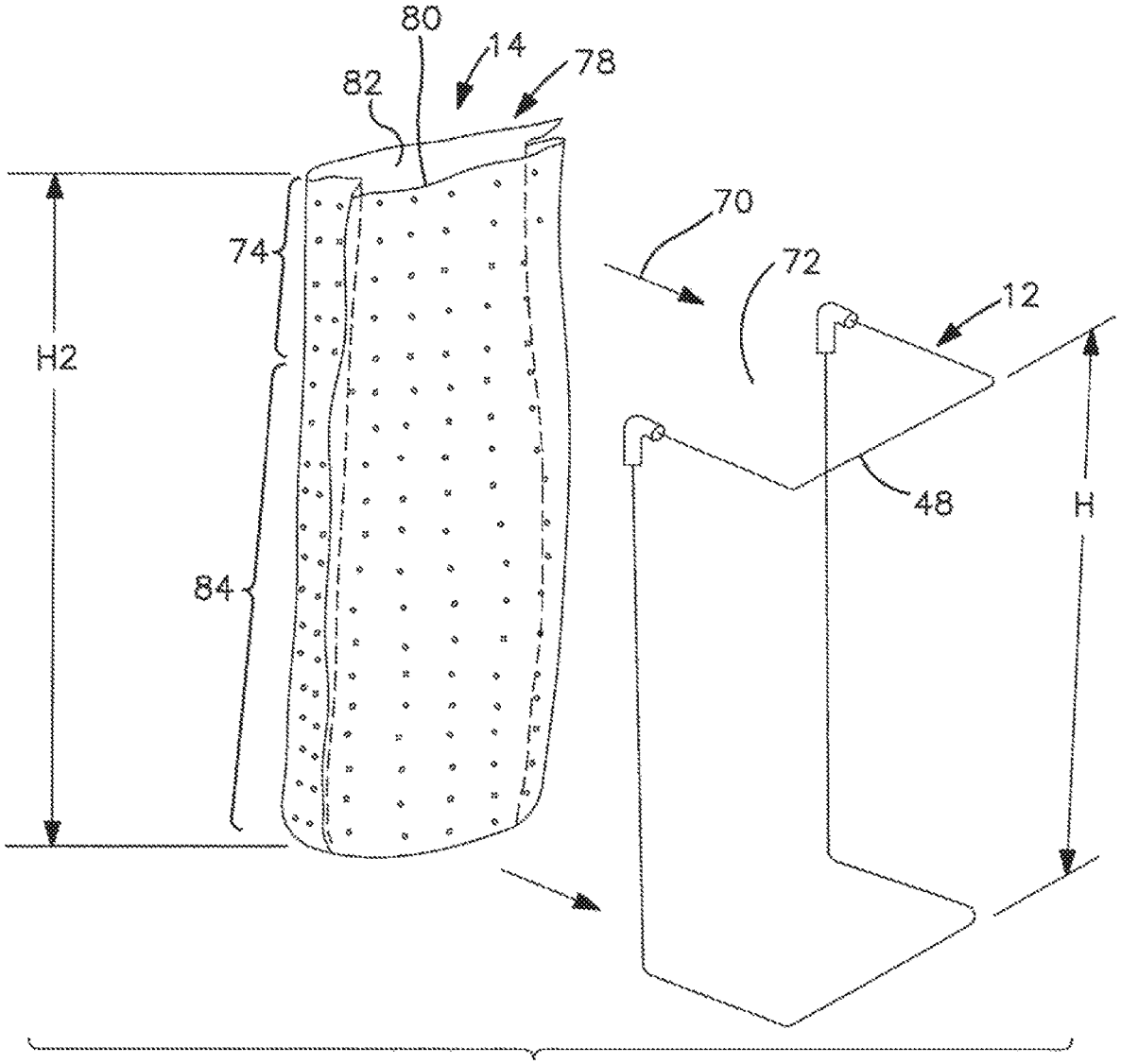
FIG. 6 is a pictorial view showing a bag of the invention positioned adjacent a rack as illustrated in FIGS. 3 and 4.

FIG. 5 shows a top view of the rack shown in FIG. 4. As illustrated in FIG. 6, the bottom of the rack has a generally wider stance, left to right and front to back, than does the top of the rack. While not critical to the invention, such wider stance provides desired stability to the rack/bag combination while the bag is being filled. A typical rack of the invention, where height "H" is 63 inches, is 26 inches wide and 26 inches front-to-back at the bottom of the rack and is 24 inches wide end 24 inches front-to-back at the top of the rack. Accordingly, such rack is about 26−24=2 inches, thus 8% wider, at the bottom of the rack than at the top of the rack. Stated another way, the stance differential can be expressed as an increment based the height of the rack, in that context, the stance differential is 2 inches width, top-to-bottom, divided by the overall 53-inch height "H" of the rack, thus 2/53, whereby the stance differential is 3.8% of the height of the rack. Modestly greater or lesser stance differentials, or no stance differential, can be employed without departing from the invention.

One skilled in the art will realize that this invention also encompasses the use of other materials for the construction of rack 12, for example and without limitation, other metals such as aluminum, as well as plastic, rubber, wood, fiberglass composite materials, carbon fiber composites, and the like. Such other materials will inherently exhibit other coefficients of friction whereby the need for use of sleeves 66 may be altered or eliminated.

Figure 7:
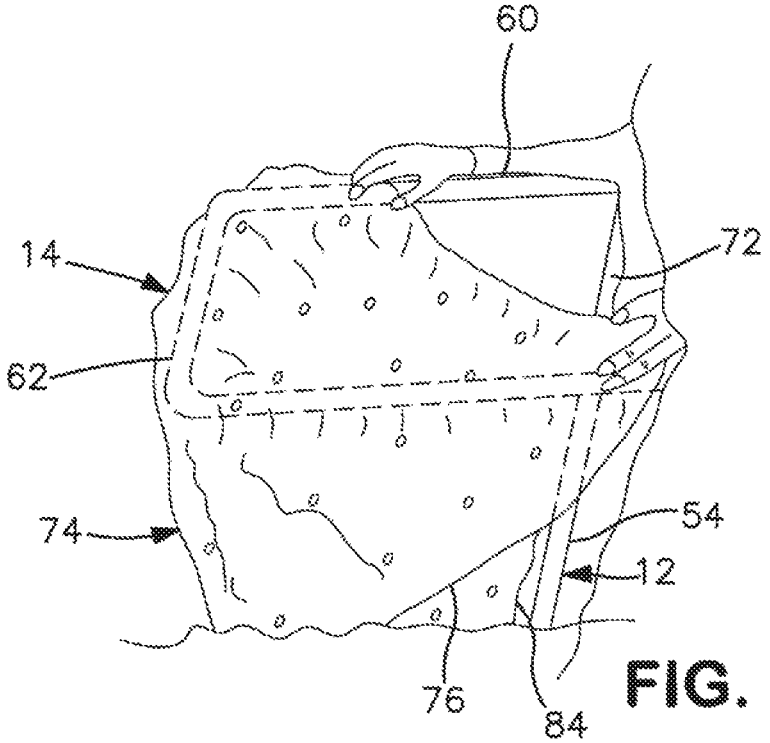
FIG. 7 shows a pictorial view of the top portion of the rack, with the bag of FIG. 6 partially installed on the rack.
Figure 8:
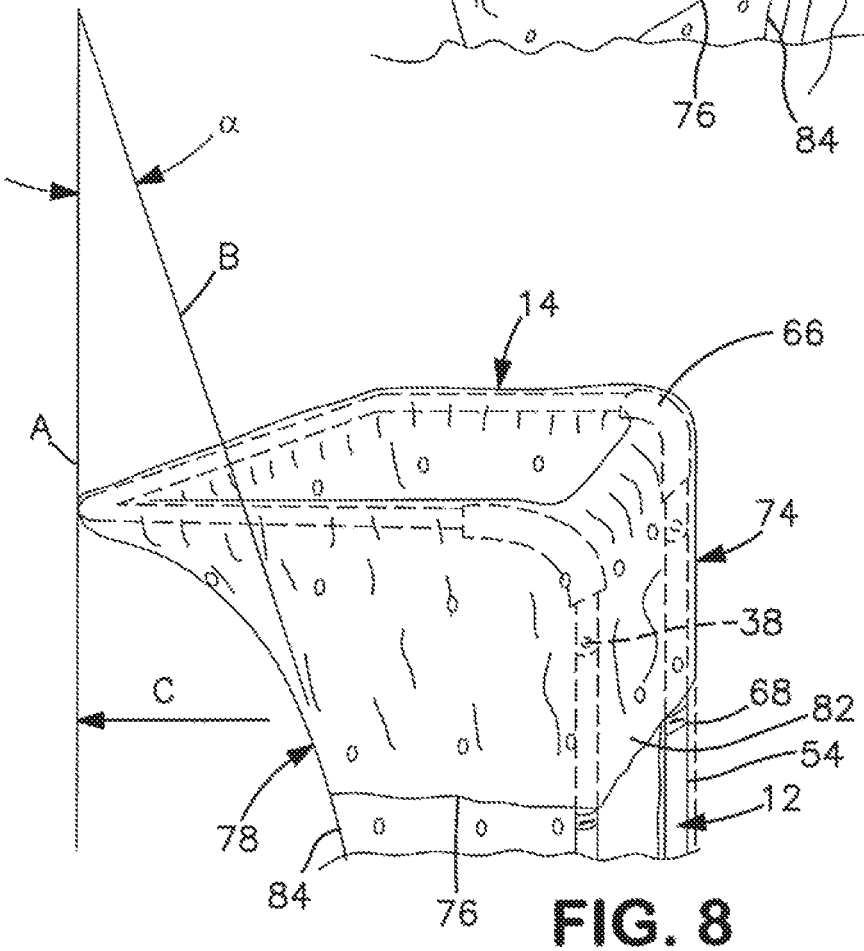
FIG. 8 shows a pictorial side view of the top portion of the rack as in FIG. 6, with the bag fully installed on the rack, and with the distal side of the bag inherently drawn toward the rack legs.
Figure 9:
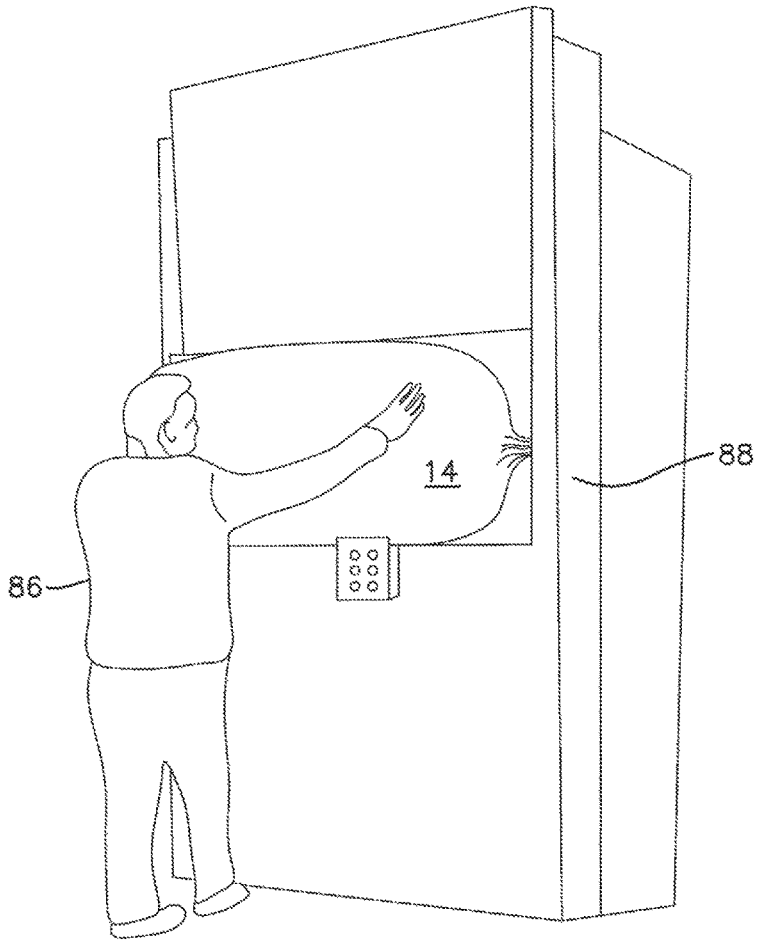
FIG. 9 shows a pictorial view of the bag filled with waste material, tied closed at the lop of the bag, and being placed in a baler.

FIGS. 6-8 illustrate the process of installing a bag 14 on the rack 12. FIG. 6 illustrates a bag in its full height, adjacent the front of a fully-assembled, upright, rack. FIG. 6 illustrates that the height "H2" of the bag is substantially greater than the height "H" of the rack. Arrows 70 suggest that bag 14 is installed on rack 12 by a worker moving bag 14 generally horizontally into the opening 72 at the front of the rack, thence toward rear 48 of the rack.

Accordingly, mounting the bag on the rack begins with the worker moving the bag from the position shown in FIG. 8 into opening 72 and generally toward the rear of the rack, with the top of the bag well above the top of the rack. At this stage, a bottom portion of the bag may drag on the underlying floor or other surface.

With the bag adjacent the rear of the rack, the worker brings the top portion 74 of the bag downwardly and outwardly about the top of the rack, thus outwardly of, and about, side arms 80 and rear arm 62 as illustrated in FIG. 7 until the rear of the top portion of the bag is generally at the elevation of the bag line marker 68 on the legs. With the top edge of the bag below the rear arm of the top of the rack, the worker works the sides of the top portion of the bag outwardly and downwardly over side arms 80 as illustrated in FIG. 7. With the top edge of the bag outwardly of, and well below the top of the rack at rear arm 62, and with the top edge of the bag outwardly of, and at least somewhat below, the top of the rack at side arms 80, the worker pulls the front of the top portion of the bag toward himself/herself and downwardly and outwardly over sleeves 68 at the front of the rack. As top portion 74 of the bag is being pulled downwardly and outwardly about the top of the rack, the top edge 78 of top portion 74 is pulled down such that the top edge/top circumference of the bag is at approximately the elevation of bag lime markers 88 on legs 54, as illustrated in FIGS. 1 and 8.

With the bag so installed on the rack, the circumference of the bag is such as to maintain a modest amount of circumferential stress/tension in the bag at the top of the rack as is inherent in the illustrated reduced bag cross-section at bag throat 78 at or adjacent top edge 74, below the top of the rack, in FIGS. 1 and 8.

While the specific distance between the top of the rack and the bag line marker 68 is not critical, the bag line markers are displaced far enough from the top of the rack that throat 78 is well developed below the top of the rack, inwardly toward the front of the rack from rear arm 62 of the upper section of the rack. Accordingly, the bag line marker is spaces from the top of the rack by a distance at least 10 percent, optionally at least 20 percent optionally at least 25 percent, as great as the overall height "H" of the rack.

The cross-section dimension of bag 14 is such that a modest amount of stress/stretch is imposed on the circumferential top portion of the empty bag as the bag is being engaged with the upper section of the rack during the mounting of the empty bag on the rack. Accordingly, once the rear side 80 of the top edge 76 of the empty bag passes downwardly past the side arms and rear arm of the rack, and with the front side 82 of the empty bag being engaged with the front of the rack e.g. at legs 54, and in the absence of any legs at the rear of the rack as illustrated in FIGS. 1 and 8, the circumferential stress in that portion of the length of the empty bag which is below and outwardly of the top of the rack moves that top portion of the empty bag toward the front of the rack. Meanwhile, the main body 84 of the bag drapes downwardly from the top of the rack and is disposed inwardly of side arms 60 and rear arm 62. Thus, top portion 74 of the bag is disposed outwardly of main body 84 of the bag, and frontwardly of rear arm 82 of the rack. Typically, those portions of top edge 78 which generally underlie side arms 60 are disposed, in a plan view, inwardly, between the left and right side arms 60. Thus, FIGS. 1 and 8 illustrate modest constrictions on the cross-section of the empty bag 14 at throat 78 when the empty bag is first mounted on rack 12.

With the bag so mounted on the rack, workers begin placing waste film or other thin-section material into bag 14. As waste material begins to accumulate in bag 14, the weight of the material in the bag begins to apply a downward gravitational force on bag 14.

The downward pull of the weight is resisted by the friction between the bag and the rack at the top of the rack. Particularly important is the friction contribution at sleeves 66. A friction enhancement is provided by the bag cross-section at throat 78. Namely, as weight/mass of waste material is added to the bag, and falls to the bottom of the bag, the weight of material in the bottom portion of the bag places a downward pull on the entire circumference of the bag material, including at throat 78. Given the angle $\alpha$ between vertical line "A", and angled line "B" which extends from top edge 76 of the bag, the downward vertical force of the waste material weight applies a horizontal/outward force vector "C" which pulls the top edge of the bag outwardly toward the rear of the rack. Such outward force at the rear of top edge 76 thus adds to the bag forces already acting perpendicular to sleeves 88, thereby enhancing the ability of sleeves 88 to resist the tendency for the main body 84 of the bag to move downward in response to the weight of the waste material being placed into the bag.

When the bag has been filled, the worker 86 lifts the top portion 74 of the bag up above the top of the rack. The worker then closes off the top portion of the bag with any desired closure, for example an overhand knot or a zip tie, or other closure device, to prevent spillage of the collected waste material from the bag. With the filled bag so closed, the filled bag is removed from the rack and transported to a desired holding location, or to a baler, FIG. 8 shows the worker 86 loading the filled bag 14 info a vertical baler 88.

Balers acceptable for use with the invention are available from e.g. Compactors Inc., Hilton Head, S.C. as vertical balers V630CC, V63HD, or V63XHD. Such balers are stated by the supplier to have 10 hp to 20 hp motors, hydraulic pump capacity of 10 gallons per minute to 15 gallons per minute, operating system pressure of 2000 pounds per square inch (psi) to 2200 psi, and maximum pressure of 2200 psi to 2500 psi, and are believed to produce platen pressure of about 34 psi to about 42 psi. Bales produced by such balers have dimensions of about 60 inches by 30 inches by 48 inches, thus bale volume of about 50 $ft^3$, and weigh about 1000 pounds to about 1300 pounds.

In the alternative, the filled bag can be set aside for transportation to the baler, or to any desired holding location, along with additional filled bags, for example in order to better control transportation costs. For example, the bag may be placed in a Gaylord, and the Gaylord retained at the bag loading site until multiple filled bags have filled the Gaylord; whereupon the Gaylord is transported to the baler or other holding location.

Referring to FIGS. 10A-10E in general, the overall shape of rack 12 can be rectangular, cubic, cylindrical, conical, spherical, amorphous, or other. The rack can be open or closed, either at the top section or at the bottom section, or both. The rack can be constructed from one continuous piece of tubing, or from multiple connecting tubes, rods, bars, plates, parts, or other sections.

The rack size in the embodiment illustrated in FIGS. 1, and 4-8 was chosen to fit a bag which can contain the same weight of waste material as can generally fill a Gaylord-type container. The shape of the rack was chosen to limit the footprint of the system while keeping the working elevation at the top of the bag at an ergonomic height for manual loading by an adult person. Alternative shapes and sizes for the rack can be used as desired without departing from the invention.

Thus, rack top 50 as illustrated in e.g. FIGS. 1, 4, and 5 is 24 inches wide from side to side, and 24 inches deep from front to back. Rack bottom 52 is 26 inches wide from side to side, and 26 inches deep from front to back. The rack stance differential, which is two inches greater at the bottom of the rack than at the top of the rack, provides enhanced stability to the rack, compared to a rack where the rack top and rack bottom have the same length and the same width. While the illustrated embodiments show the rack top and the rack bottom having the same plan view configurations as in FIG. 5, e.g. both square, both round, or both triangular, such sameness is not required. For example and without limitation, the bottom can be square or rectangular while the top is circular, triangular, a pentagon, an octagon, or round; or the rack top and bottom can be reversed from the immediately foregoing description.

Further, the base section of the rack can be made of a more massive, more dense, or heavier material than the upper section. For example, the base section can be formed using solid rod steel or aluminum while the upper section is formed using tubular steel or aluminum. Further, the rack can be made from square solid rod or hollow tubing, or metal having a U-shaped cross-section sometimes referred to as "channel iron", or a right angle cross-section commonly referred to as "angle iron".

In the embodiments illustrated in FIGS. 1 and 4-8, rack elbows 64 at the top of the rack, between side arms 60 and rear arm 62, and between side arms 80 and legs 54 have radii of 2.5 inches. Such elbows are designed to keep the bag from tearing, such as if the elbows were to have radii which were too small, or from falling off such as if the elbows were to have radii too large. The 2.5 inch radius for these illustrated embodiments have been found to provide acceptable bag grip, with a gloss powder coating on the rack. Other radii may be appropriate if tube diameter is different, or if the tube outer surface has a different inherent coefficient of friction relative to the material of the bag to be used with the respective rack. Thus, in some embodiments, the elbow radii can be greater than, or less than, the above-recited 2.5 inches.

Figure 10A:
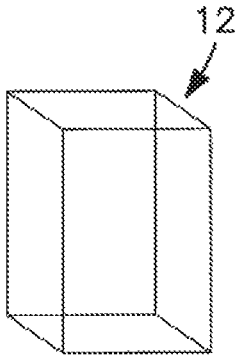
FIGS. 10A-10E are line drawings showing five different exemplary tubing/rod configurations for racks of the invention.
Figure 10B:
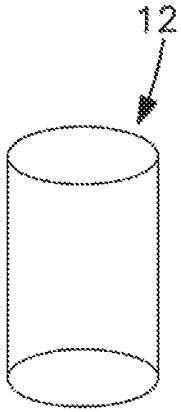
Figure 10C:
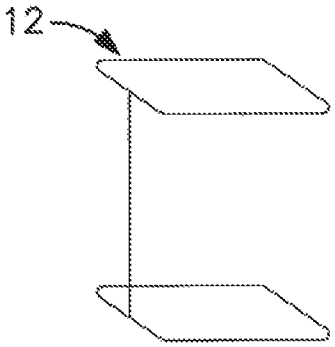
Figure 10D:
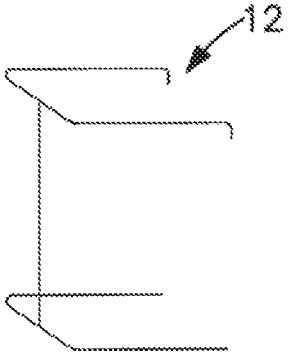
Figure 10E:
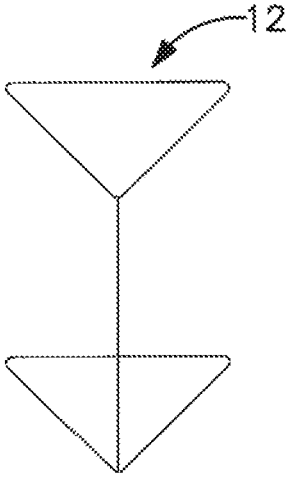

The cross section of the rack can be solid or hollow, and the rack can contain various wall thicknesses within a given cross section or along the length of a rack section. The shape of the cross section of the rack elements, e.g. upper section, bottom section, and/or leg sections, can be circular, square, rectangular, elliptical, triangular, or other shapes, and the cross-section can vary in size and shape along the length of the structure while accommodating any or all of the structures shown in (FIGS. 10A and 10E).

Figure 11:
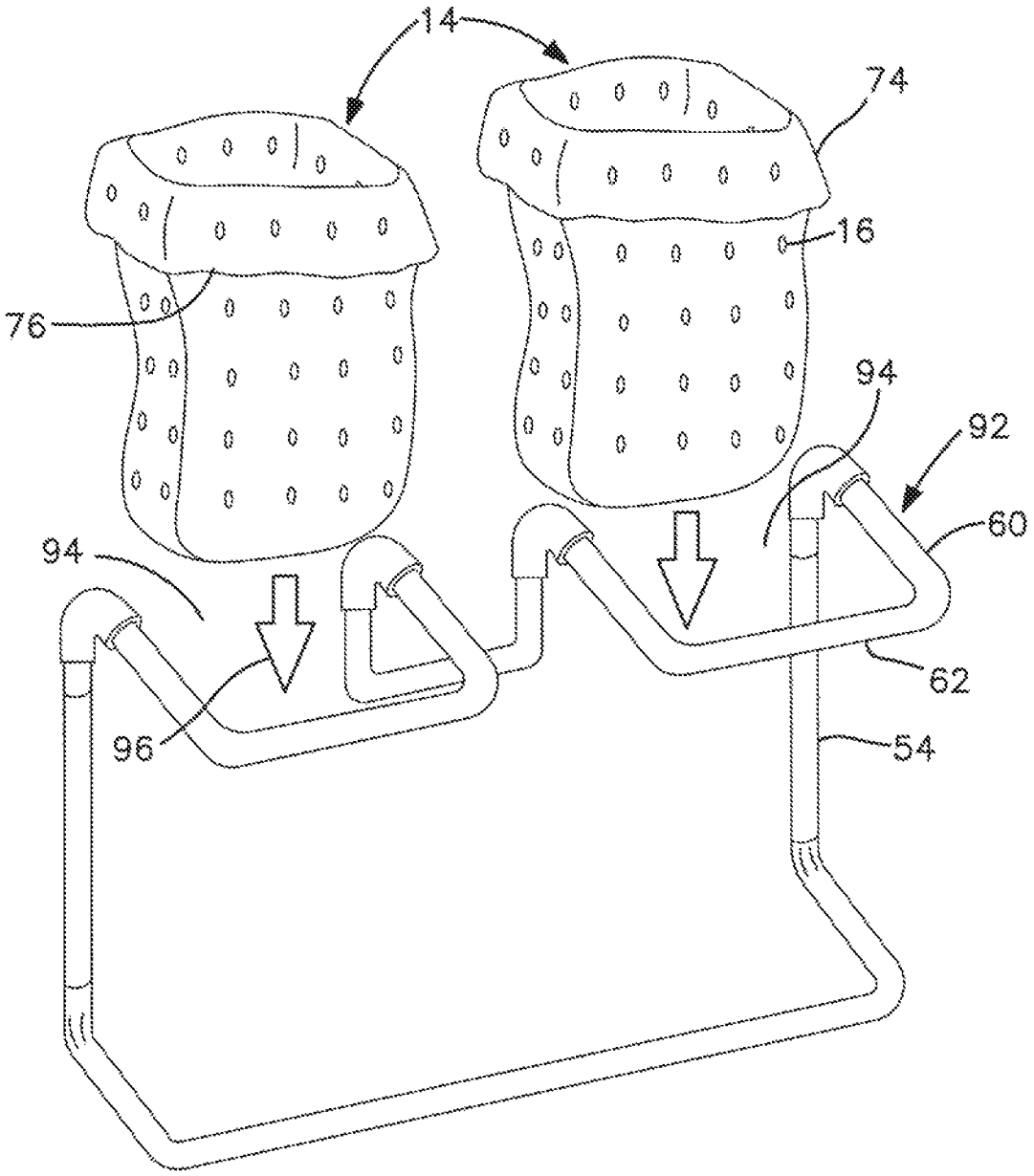
FIG. 11 is a pictorial view of a rack of the invention having first and second bag receiving stations, with the bags shown above the receiving stations, the rack being capable of simultaneously holding first and second bags of the invention.

FIG. 11 shows an exemplary rack 92 having first and second beg stations 94. Bags 14 are shown above the bag stations. Arrows 26 indicate that the bags can be mounted by downward movement of the bags into the respective bag stations 94. In the alternative, the bags can be mounted to the rack by starting with the bottoms of the bags at the same elevation as the bottom of the rack, and moving the bags horizontally into and through the front of the rack, to the rear of the rack as in FIGS. 6-8, and, overall, installing the bags as shown in FIGS. 6-8. One benefit of a 2-station rack is that the collection of waste material can continue for a relatively longer period of time than needed to fill a single bag, before bags need to be replaced in the rack. A second benefit of a 2-station rack is that two different types of waste can be placed in the two bags, thus segregating different types of waste material, e.g. paper and plastic, or polyethylene and polypropylene, at the collection site, resulting in higher value of the waste material as bagged.

The portion of rack 12 or 92 which contacts the floor may be left bare, or may be painted or otherwise coated. Rack 12 can have feet, wheels, sliders, or other components to hold the rack in place, to level the rack, or to enable the rack to move relatively easily to and from any desired location.

The Bag

Bag 14 is designed to receive and hold recyclable thin-section materials such as paper or thin-section plastic film. In one embodiment, the bag, itself, is made from low density polyethylene, also known as LDPE, and is used to store recyclable materials made from the same material, namely LDPE, recognizing that the acronym LDPE represents a lame family of polymers having different structures and properties, though the structures and properties are generally similar. As desired, other materials can be used for the bag including woven cloth, other plastics, rubber, etc., and combinations of materials can be used within a given bag. In general, the material used tor the bag is desired to have the same composition as the material which is expected to be placed in the bag for recycling so that the value of the entire bag, including both the bag, itself, and the bag contents, is maximized. In such instance the total shipment, namely bag plus bag contents, can be received at the recycling center with the aim of processing/recycling both the bag material and the bag contents as one charge of recyclable material, to obtain a recycled product having a high fraction of a common polymeric composition or very similar compositions.

In some embodiments, the bag is clear/transparent, enabling a user to see through the bag wall, thus to view the materials placed inside the bag. Such transparency helps a user to inspect the bag contents periodically in order to avoid placing an inappropriate mix of materials in the bag during the bag filling process. However, other bag colors and opacities are contemplated as being useful in some embodiments of the invention.

Whatever the rack size and configuration, the bag is sized and configured to fit the rack and to enable easy mounting of the bag onto the rack and removal of the bag from the rack, while imposing enough stress in the bag at the top of the rack, while the bag is being mounted on the rack, to enable the bag to remain in place, mounted on the rack, while the weight of waste being placed into the bag pulls down on the bag. Given the flexibility of the bag material, and in light of the disclosure herein, bags can be configured for cooperative operation with all of the rack shapes depicted in FIGS. 10A-10E.

Bags 14, themselves, are typically made of plastic film extruded through a circular die. Bag wall thickness is typically generally constant about the circumference and length of the bag, according to thickness consistencies which can be achieved in conventionally-practiced extrusion processes. As desired, bag wall thickness can be intentionally varied e.g. to increase strength only where needed while minimizing material usage. For the uses illustrated herein, and assuming a composition dependent primarily on ethylene-based polymers such as LDPE or LDPE-based polymers or copolymers, and assuming constant bag wall thickness, typical bag wall thickness is about 1.25 mils to about 10 mils, optionally about 1.6 mils to about 6 mils, optionally about 2 mils to about 4 mils, optionally about 2 mils. A bag having a 2-mil wall thickness is satisfactory to hold as much of the volume of recyclable plastic film scrap as most end users are able to get into a bag having a height "H" of about 53 inches, and adapted to be mounted on a rack such as that illustrated in FIGS. 1 and 4-6, the rack having a square top opening of about 24×24 inches and a square bottom stance of about 26×28 inches. Where relatively heaver, more dense, waste material is to be placed in the bag, a heavier gauge plastic, such as e.g. 4 mil plastic or 8 mil plastic, may be more appropriate.

The bag, as produced, is a flat collapsed bag, which may be folded longitudinally on itself for packaging and/or shipping as illustrated in FIGS. 1 and 2. An exemplary collapsed, flat bag, is 80 inches tall by 44 inches wide. Such exemplary bag, adapted to fit the square 24×24 inch top rack dimension suggested above, when opened, but not stretched, at the top is 22 inches on each of its four sides when in a square configuration. Thus, the unstressed dimension of the bag, at 22 inches by 22 inches, is less than the nominal 24×24 inch dimensions across the rack at the top of the rack. Such lesser circumferential dimension, and lesser dimensions across the bag opening, relative to the rack at the top of the rack, is believed to be linked to, substantially contribute to, the observed automatic development of throat 78.

Given that the intended use of the bag is to receive thin-section waste material, whether paper, plastic, or other thin-section material, it is known that such thin-section waste materials are quite flexible. Given that the material is considered waste material, little effort is made by workers who retrieve, pick up, clean up, such waste material, to preserve any particular configuration for such material, or to closely pack such waste material while placing the waste material into bag 14. Rather, since waste material has only limited monetary value, priority is typically given to disposing of, processing, such waste material with as little labor as possible. Accordingly, workers are typically instructed to dispose of the waste material by simply placing as much of such material as possible into an available waste receptacle, with no regard for the configuration of the waste material the waste receptacle.

As used herein, the phrase "sheet material" generally refers to plastic films and sheets, and sheets of paper. Films are generally rip to 10 mils thick, including stretch films, shrink films, non-stretch films, and non-shrink films. Sheets are generally plastic materials greater than 10 mils thick, or paper.

Typically, where the wall thickness of bag 14 is up to 10 mils, the plastic pieces placed in the bag can be up to about 50 mils thick. Considering thicker waste plastic pieces, especially where the thickness is over 50 mils, there is a risk that the waste pieces may penetrate the bag walls. Accordingly, bags used to receive such thicker waste pieces have wall thickness greater than 10 mils. Those skilled in the art will be able to determine the necessary wall thickness for such bags. However, the wall thickness of the bag cannot be so great that the bag cannot be effectively collapsed in the baler with release of substantially all air from the bag. If is recognized, however, that the forces used in typical industrial commercial balers are unlikely to expel, release, 100% of the air inside the bag when the filled bag is compressed in the baler.

Returning now to discussion of recycling of typical flexible waste material, such flexible waste material may be inherently folded, bent, or the like during the process of being thrown, tossed, or placed casually into the bag. By "placed casually" is meant that the worker makes little or no effort to configure the waste material in the receptacle in order to enhance the bulk density of the material in the receptacle. Rather, the worker typically moves pieces of the waste material to the top of the open bag, as mounted on the rack, and allows the material to fall into the bag/receptacle in a random, uncontrolled arrangement.

Where the waste material is in the form of small consistent-dimension sheets or films, such sheets or turns may be placed, thrown into the receptacle by the handful. A larger piece of waste material may be folded, typically loosely folded, as it is being placed into the receptacle, in order that the large piece have a small enough bulk, 3-dimensional cross-section to be placed into the receptacle. For example, where a large protective piece of shrink wrap plastic film is removed from a skid of product, the piece of plastic film may have length and/or width dimensions larger than the opening in the waste receptacle. Such large piece may be folded or loosely rolled up or otherwise configured as the piece of waste material is being placed into the receptacle. In some instances, the waste material may consist of irregularly-shaped sheets or films, for example scrap film generated during the start up or shut down of an extrusion process. Such waste material may vary in size and shape from piece to piece.

Whatever the size or shape of the waste material, whether film or sheet, the waste material placed info receptacles/bags 14 of the invention typically occupies only a small fraction of the gross space contained within the walls of the bag. The remainder of the gross space is occupied by air.

One of the challenges in recycling waste thin-section materials is that such thin-section waste materials, as collected, have low bulk densities. Typically, waste materials must be transported to a location where the waste materials can be processed for conversion into new and useful products. But the cost of transporting such low-value materials in low bulk density form is unacceptably high. Thus, it is critical to be able to compress such waste materials, thus to increase bulk density, by removing air from the materials so compressed, in order that transportation costing be correspondingly improved.

Polymers typically have densities in the range of about 0.83 to about 2.15. Polymers in plastic film materials contemplated to be most commonly recycled using the invention are polyolefins, which typically have densities of about 1.0 or less, commonly between about 0.86 and about 0.95. While recycling films or sheets of polyolefins is contemplated as the most common use of the invention, recycling of other waste polymer compositions is also within the scope of the invention so long as snob waste material is a thin-section material which enters bag 14 as a generally low bulk density material.

While materials having relatively greater bulk density can be loaded into the bag, a potentially greater respective weight in the bag may suggest respectively greater bag wall thickness and/or different polymer selection and/or multiple layers of different polymer compositions for the bag side wall in order to accommodate the e.g. tensile strength of the bag side wall to fine load to be carried in the bag.

While rack 12 is focal to holding bag 14 in place while the bag is being filled, reducing the amount of air in the bag, and thus increasing the bulk density of the waste material contained within the bag, is also critical to the invention.

To that end, holes 16 are formed in the bag, typically while the bag is flat as shown in FIGS. 2 and 3. The holes provide escape paths which enable air to escape from the bag in the baler, namely while the baler is compressing the filled bag after the bag has been filled with e.g. plastic film to be recycled. Hole size and locations are designed and configured to facilitate release of as much as possible, namely substantially all, of the air in the bag, within the working limits of the baler, while the bag is being compressed in the baler.

To that end, in the above embodiment where the bag is 80 inches tall and 44 inches wide, 104 holes 16, each ⅜ inch in diameter, are formed in the bag such as by the use of one or more mechanical punches. Preferably, but not necessarily, the holes are clear of hanging chads or flaps.

In the illustrated embodiments in FIGS. 1 and 4-8, the holes are spaced 6 inches apart top-to-bottom, and 12 inches apart going around the girth/circumference of the open bag, providing an open area, as a hole fraction of the wall area of the bag, of about 0.15%, for traverse of air exiting the bag as the filled bag is being compressed in the baler. The hole fraction of the wall surface of the bag can vary depending on the surface characteristics of the recyclable material to be placed in the bag. Thus, where the material being recycled has an affinity for itself and/or for the material of the bag wall, the hole fraction can be relatively greater. Similarly, where the material being recycled is rather dense and/or has little affinity for itself and/or for the material of the bag wall, the hole fraction can be relatively smaller.

To that end, the hole fraction of the wall, namely the fraction of the bag wall area represented by the holes can be from about 0.05% to about 1%, optionally about 0.07% to about 0.5%, optionally 0.07% to about 0.25%.

Configurations of the individual holes can be round, oval, oblong, or otherwise elongated, can have bends, corners, and the like. Such holes can be regular polygons, irregular polygons, and any of a wide variety of cross-section shapes.

In preferred embodiments, all of the material outlined by the hole is removed from the hole as the hole is being formed. In some instances, the punch/die used in forming the hole is designed to leave the punched-out portion of bag wall material attached, as a hanging chad, at a single location about the otherwise complete circumference of the hole. In some embodiments, material is left uncut at two locations about the circumference of the hole, typically opposite each other across the hole, thus creating two hole elements, and leaving two hanging chads for each hole Leaving the one or more chads attached at the hole circumference provides the benefit of eliminating much of the litter of punched-out hole pieces at the punching work station, and provides for recycling, along with the bag, of the pieces punched out of the bag wall at the holes.

On the other hand, leaving hanging chads at the holes enables the chads to move into some of the hole passages as the air is being urged to escape from the bag during baling. Thus, the less the attached hole material at the holes, the easier it is for air to escape as the bag is being compressed in the baler, thus to obtain a bale having a relatively higher bulk density.

For purposes of ease of removing air from the bag, the bag wall material inside the area punched by an individual punch in making a hole can be completely removed while making the holes because, when a flap/chad of material is left attached to the hole, the hole does not work as well for removing air from the bag during baling as does a similar size hole, in a similar hole-pattern, where the flap/chad has been removed from the area of the hole. Thus, where chads are contemplated, a relatively larger hole size is typically specified in order to enable removal of a contemplated amount of air during compression in the baler.

Hole size, shape, spacing, and arrangement patterns can be varied within the scope of the invention. Assuming a round, circular hole, hole size can range from 0.03 inch diameter to about 0.75 inch diameter, optionally about 0.13 inch to about 0.6 inch, optionally 0.25 inch to about 0.4 inch with the number of holes varying correspondingly to provide for a hole fraction at least one third as great as the hole fraction inherent in the above example of 104 holes each ⅜ inch diameter, and a hole fraction no more than 7 times as great as the respective example. Again, hole size, and hole fraction, depend on the make-up, including physical properties, of the recyclable material to be placed in the bag.

Relatively smaller size recyclable material pieces require relatively smaller holes. Relatively larger size recyclable material pieces suggest relatively larger holes conditioned, however, on the surface characteristics of the waste material. For example, waste material which tends to adhere to itself or to the material of the wall of the bag, e.g. by surface properties or chemical adhesion, requires an additional consideration of hole size, hole fraction, and hole spacing in order that the contained recyclable material not unacceptably obstruct the holes and thus hinder the air from exiting the bag through the respective holes. What is important is that the air contained in film or other waste inside the bag be able to move, under compression from the baler, to and through the holes in the bag wall.

Figure 12A:
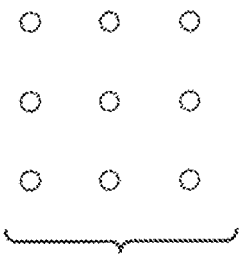
FIGS. 12A-12D illustrate exemplary hole pattern for the bags.
Figure 12B:
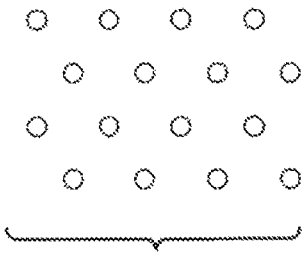
Figure 12C:
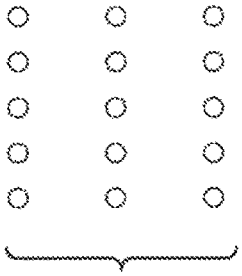
Figure 12D:
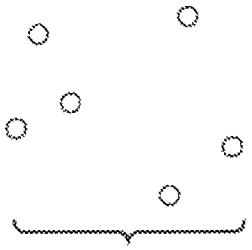

The arrangement of the holes can be any of a variety of hole patterns such as the hole pattern illustrated in FIGS. 12A-12D. Thus, the holes can be arranged in a square matrix as in FIG. 12A, in a diamond-shaped pattern as in FIG. 12B: in an array of columns as in FIG. 12C and as in the 6-inch by 12-inch arrangement discussed above; or the holes can be arranged in a repeating random pattern one of which is shown in FIG. 12D, or can be arranged randomly in no pattern at all, though typically with a relatively consistent hole fraction over a given area of the bag side wall. The hole patterns shown in FIGS. 12A-12D are exemplary only, not limiting, of the hole patterns which are operable as part of the systems, products, and methods of the invention.

The shape of any given hole can be configured to optimize bag strength. Thus, the hole can be a circle, a slot, a slit, or oblong, or star-shaped, or any other desired shape, if desired some or all of the holes can be reinforced with one or more additional layers of material, the reinforcing material being limited in area, to surrounding only a hole or a cluster of holes. Such hole reinforcement is defined only about the holes and only with respect to no more than about five percent of the surface area of the bag material.

Typically, the holes are spaced apart an average of at least about 3 inches, optionally at least about 4 inches, optionally at least about 5 inches, with each hole being within at least 18 inches, optionally 15 inches, of another hole. The arrangement of the hole array need not be square, need not be rectangular, need not be diamond shaped, though all such arrangements are acceptable. As illustrated in FIG. 12D, the hole arrangement can be rather irregular, so long as the overall arrangement provides suitable escape paths enabling a high fraction of the air to escape from the bag when the bag is compressed in a baler. While the exact fraction of air left in the bale vanes from bale to bale, use of bags of the invention having such holes in the side wall, to receive and hold waste plastic film, results in a bale which has a greater weight, as expelled from the baler, than a bale made using corresponding plastic film, where the film is loaded loosely by hand into the baler intake area. Such incremental weight increase, for the same volume bale, formed by the same baler, is typically at least about 10 percent to about 15 percent, and up to 25-30% in some instances.

Attachment of the Bag to the Rack

Gravity, and friction between the bag and the rack, may be the primary forces holding the bag in place. To that end, properly contoured rack, bends and rubber sleeves can assist in holding the bag in place. Where the bags is 2 mils thick, 80 inches high, 88 inches around at the top edge, where the rack is 53 inches high. 24 inches square at the top, 28 inches square at the bottom, where the holes are ⅜ inch diameter and spaced in a 6×10 inch linear/columnar matrix, where the rack bends at the top of the rack, front and rear, are 2.5 inches radius, the respective system works quite satisfactorily to receive thin-section waste LDPE film. Substantially smaller radius tends to overstress an almost-fully-loaded bag at the upper corners of the rack. Where the radius is substantially greater, an almost-fully-loaded bag tends to slip downwardly on the rack. However, any potential deficiency in rack radius, whether relatively greater or smaller, can be resolved by adding a longer sleeve 66, or by adding sleeve material or other friction material at additional locations on the top of the rack. Alternatively, the bag may contain strings, belts, flaps, buttons, Velcro, etc. with or without the use of clips, pins/posts, and slots on the rack, to help keep the bag in place during loading. Also as the rack size or surface properties are changed, the bag configuration and/or the friction sleeves or other friction elements on the rack may need adjustment/modification in order to maintain the bag mounted on the rack while the bag is being filled with waste material.

Friction sleeves 60 at front elbows 64 of the upper section of the rack are designed to keep bag 14 from tearing, or slipping off the rack, during loading of recyclable material info the bag. Sleeves 66 can enclose all or a portion of the circumference of the cross-section of the rack at the respective elbow. Sleeves can be made from any material such as for example and without limitation, cork, plastic, rubber etc., and any of a wide variety of textured surfaces which have surface friction greater than the surface friction of the e.g. powder-coated rack tubing itself. One such acceptable sleeve material is a foamed neoprene rubber tube. Such neoprene rubber tube has a nominal inner diameter the same dimension as the rack tubing, and a wall thickness about 10-15% as great as the inner diameter. Thus, where the rack tubing has an outside diameter of e.g. 1 inch, sleeve 66 has an inner diameter of about 1 inch and an outer diameter of about 1.25 inches.

Figure 13:
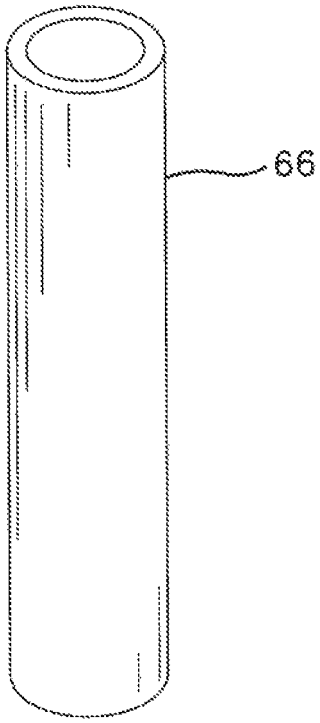
FIG. 13 is a pictorial view of a friction sleeve used to stabilize the bag at the front corners of the rack, as shown on the rack in e.g.
Figure 14:
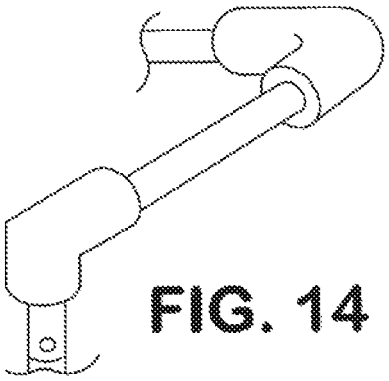
FIG. 14 is a pictorial view of a top portion of the rack where friction sleeves as illustrated in FIG. 13 are installed on both the front and rear ends of the tubing at the top of the rack.

FIG. 13 shows a pictorial view of a sleeve 66 which is used at elbows 64 at the top of the rack as illustrated in e.g. FIGS. 1 and 8. Where use of sleeves 86 at elbows 64 at the front of the rack is insufficient to stabilize the bag through the entirety of the process of loading the bag with waste material, additional sleeves 68 can be added to the rack at other locations. A typical such addition of a sleeve 66 at the right rear elbow 64 in the top of the rack is illustrated at FIG. 14. Where a sleeve 56 is added at the right rear elbow, a corresponding sleeve is typically added at the corresponding left rear elbow.

FIGS. 15-22 show other embodiments of material, not necessarily a sleeve 66, used as bag retainers on the rack, effective for holding the bag stable on the rack while the bag is being filled with waste material.

Figure 15:
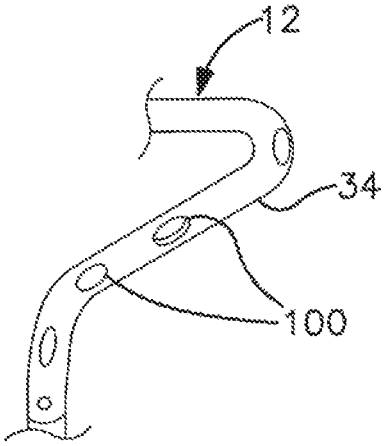
FIG. 15 is a pictorial view of a top portion of the rack as in FIG. 14, but where multiple friction elements are mounted to the tubing, at spaced bag-contact locations, at the top of the rack, in place of the friction sleeve FIGS. 13-14.

FIG. 15 shows bag retainers in the form of a plurality of protuberances 100 mounted to the upper section 34 of the rack. Protuberances 100 can be for example and without limitation, tabs, buttons, beads, made of material having desirable coefficients of friction suitable for assisting in retaining the bag on the rack. Such protuberances may be mounted to the rack by adhesives, by rivets, by rubber grommets, or any other conventional means of mounting such protuberances to a substrate material. The protuberances may function primarily by frictional engagement of the bag, such as suggested at FIG. 15.

Figure 16:
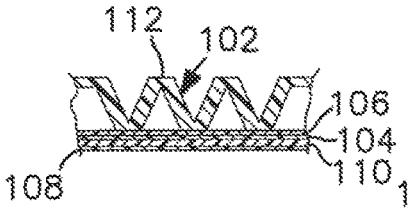
Figure 17:
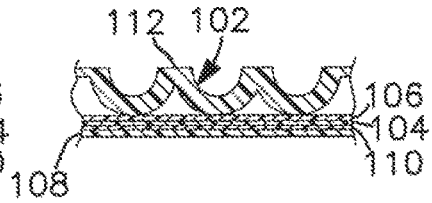

Another primary method of functioning for protuberances 100 is for the protuberances to extend sufficiently from the rack to act as point restrictors, optionally in combination with friction properties of the protuberances, FIGS. 16 and 17 show retainer structures which have a combination of an undulating protuberance layer 102 mounted on a substrate layer 104 by an adhesive layer 108. A peelable layer 108 is mounted to substrate layer 104 by an adhesive layer 110. Such retainer structures may be fabricated in either sheet form or in strip form. In sheet form, such retainer structures can be sized/cut so as to wrap about up to the full circumference of the rack tubing at any location where such retainer structure is to be employed. For example, the retainer structure can be sized to generally wrap around the tubing at the front upper elbows 64 and at the rear upper elbows. After the retainer structure is so sized, the peelable layer is removed from the retainer structure, exposing adhesive layer 110. The retainer structure is then adhesively mounted to the respective rack elbow at the desired location.

In the alternative, the retainer structure can be fabricated in strip form. Such strip retainer can then be simply cut to length, the peelable layer 108 is removed, and the adhesive layer 110 is used to adhesively mount the strip to the rack tubing at a location where the bag will encounter substantial stress during loading of the bag with waste material. Any desired number of strips can be mounted to the rack in order to achieve bag stability while the bag is being loaded with waste material.

In some embodiments, the retainer strip can be fabricated as a roll of such retainer. In such instance, peelable layer 108 is obviated such that adhesive layer 110 is directly adjacent an underlying layer of the multiple-layer structure in the roll and in contact with, contacting, the underlying protuberance layer. Thus, just as one unrolls a length of any tape in order to obtain a desired length of such tape, so such multiple-layer retainer structure can be stored in roll form, and unrolled and cut, to directly expose adhesive layer 108, which can then be applied to the rack tubing.

In FIGS. 16 and 17, protuberance layer 102 undulates longitudinally, defining lends 112 extending along the length, or width, or both length and width, of the sheet or strip. Such strip can be mounted on the rack retainer either with the lands extending along the length of the respective rack tubing, or across the length of the rack tubing or both along and across the length of the rack tubing. Either way, upstanding lands 112 are disposed away from the rack substrate and toward a bag 14 which is mounted on the rack. The primary difference between the retainers of FIGS. 16 and 17 is in the configuration of the cross-section of protuberance layer 102. Namely, in FIG. 16, the cross-section of the protuberance layer is generally "V" shaped while, in FIG. 17, the cross-section of the protuberance layer is generally "U" shaped.

Figure 18:
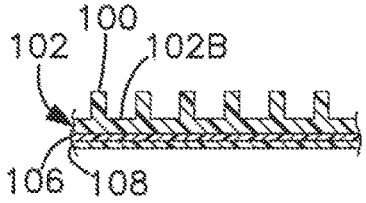
FIG. 18 is a side elevation view showing a cross-section or the tubing at the top of the rack, with a spring-loaded clamp being used, instead of friction materials, to stabilize the bag at the rack.

In FIG. 18, protuberance layer 102 has a generally flat substrate portion 1028 which performs the same function as substrate layer 104 in FIGS. 16-17, and protuberances 100, integral with the substrate portion, perform the same function as upstanding lanes 112 in FIGS. 16-17. Because protuberance layer 102 can function both as substrate and as protuberances acting against bag 14, the separate substrate layer 104 is omitted, and adhesive layer 106 is selected for its ability to perform the necessary adhesive functions both in contact with protuberance substrate portion 1028 and with respect to peelable layer 108.

As illustrated in FIG. 18, a given protuberance 100 may extend the full length of the substrate, away from the viewer in FIG. 18. In the alternative, protuberances 100 may represent a matrix of individual discrete protuberances, extending both across the width of FIG. 18 as viewed, and away from the viewer, thus to form an x-y matrix of generally separated such protuberances.

Figure 19:
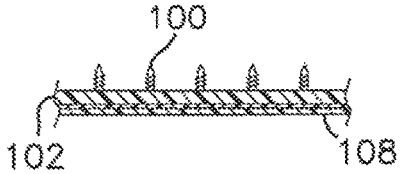
Figure 20:
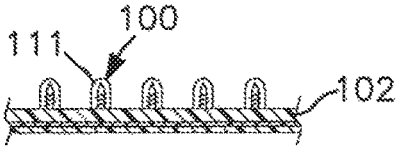
FIGS. 20-21 are cross-sections of tapes which can be employed at the top of the rack in place of the friction sleeve of FIGS. 13-14 or friction elements of FIG. 15, or the textured friction strips of FIGS. 17-19.

FIGS. 19 and 20 illustrate x-y matrix structures similar to that of FIG. 18 except that protuberances 100 are separate items mounted to substrate layer 102, rather than being integral with the substrate layer. Protuberances 100 are illustrated in FIG. 19 as threaded connectors such as the shanks of blunt-pointed screws, where the screw heads are embedded in substrate layer 102. The embodiment of FIG. 20 is similar except that the screw shanks are enclosed in a polymer composition 111, e.g. a relatively higher friction plastic or rubber composition, so as to cover any sharp edges of the screws. Thus, the protuberances in FIGS. 19-20 operate as point restrictors in addition to any frictional engagement with the bag which may occur, the point restrictor functionality be most operable in the embodiment of FIG. 19. The embodiment of FIG. 20 operates as a less aggressive point restrictor, and a more frictionally-engaged point restrictor, compared to the embodiment of FIG. 19. The sharper the point on the protuberance the more the protuberance operates as a point restrictor. Similarly, not shown, nails can be substituted for the screws, with or without the polymer enclosures shown in FIG. 20, with similar corresponding point restrictor functionality.

Figure 21:
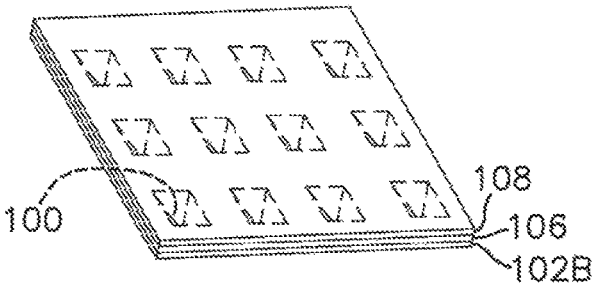
Figure 22:
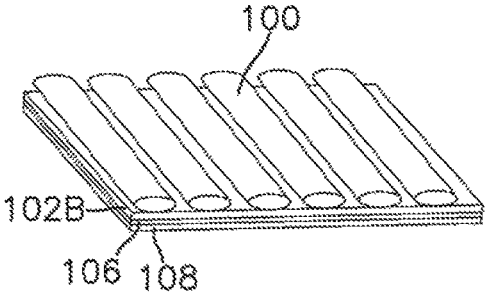

FIGS. 21 and 22 are similar to FIGS. 18-20 in that substrate layer 102 has a generally flat substrate portion 102B which can be adhesively mounted directly to the rack tubing after removing peelable layer 108 to expose adhesive layer 106, and wherein the protuberances are separate elements which are either formed with the substrate portion or are mounted to the substrate portion 102B so as to be integral with substrate portion.

In FIG. 21, substrate portion 102B is the bottom layer of the structure and protuberances 100 are arranged in a square x-y matrix with the protuberances portrayed as 4-sided pyramids pointing downwardly from substrate portion 102B. Depending on the material from which protuberances 100 are fabricated in FIG. 21, the protuberances may interact with the bag film both as friction elements and as point restrictors. Thus, if the protuberances are soft, and flexible, such as a relatively soft rubber or soft plastic, friction properties will be operating as the primary bag control, and point restrictor properties will be operating as bag control in a lesser capacity. In the alternative, where the protuberances are hard plastic or e.g. metal, and terminate in relatively sharp points, the primary bag control will be as point restrictors, with any factional properties operating as bag control in a lesser capacity.

In FIG. 22, substrate portion 102B is the top layer of the structure and protuberances 100 are arranged as side-by-side rows of oval tubes or rods extending upwardly from the substrate portion, in the embodiment of FIG. 22, protuberances 100 are represented as elongate oval structures, arranged side by side, extending in a common direction, and mounted to, or otherwise integral with, substrate portion 102B. As illustrated, the long cross-sections of the protuberance ovals extend generally parallel to the substrate and the short cross-sections of the protuberance ovals extend in an upward direction from the substrate portion. Accordingly, the point radii of the ovals, which interacts with the bag, is relatively larger whereby point restriction properties are generally low or non-existent and the affect of the protuberances on the bag is largely a friction interaction.

In an embodiment not shown, protuberances 100 of FIG. 22 are rotated 90 degrees about their centers of rotation. Such embodiment places the long axes of the protuberance cross-sections extending in an upward direction from the substrate portion, thereby engaging a modest level of point restriction between the protuberances and bag 14, as well as potentially engaging friction-based properties.

The protuberance properties illustrated in FIGS. 15-22 are exemplary, only, of surface characteristics which can be designed, developed for substrates which can be mounted on the rack material. Any such protuberance-bearing substrates can be mounted as a sleeve, as a sheet, or as a sheet, or any other configuration which can be mounted to the rack material so as to face, and interact with, bag 14.

While protuberance properties have been illustrated for elements which are mounted to the rack material, it is also contemplated that the rack material, in this case rack metal tubing, can be similarly modified so as to exhibit either friction properties, or point restrictors, or both. In addition, various coating materials can be applied as thin film coatings, e.g. "painted" on the rack tubing in order to impart friction-based properties to the rack tubing, either alone, or in combination with point restrictors fabricated into the surface of the rack tubing. Such coatings may be relatively smooth and thereby operate primarily on the basis of friction properties or may include point restrictors such as e.g. sand particles so as to operate at least in part as point restrictors.

Figure 23:
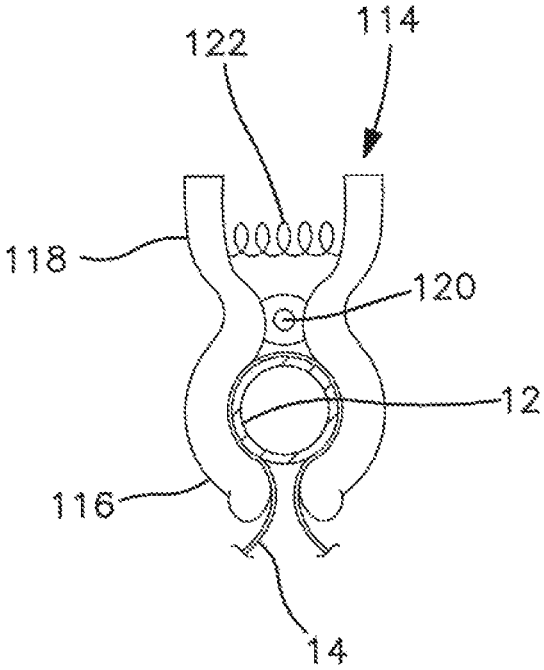
FIGS. 22-23 are pictorial views of additional illustrative tapes which can be employed at the top of the rack.

FIG. 23 illustrates yet another method of stabilizing bag 14 on the rack while the bag is being filled with waste material. In FIG. 23, a spring clip 114 is mounted to the rack over the bag material. Spring clip 114 has first and second jaws 116 and respective first and second grips 118. The first law and the first grip are shown as a first single element. Likewise, the second jaw and the second grip are shown as a second single element. The first and second jaw/grip elements are connected to each other by a pivot pin 120 which enables the grips to be squeezed together to open the laws. A compression spring 122 is mounted between the first and second grips. Spring 122 biases the grips away from each other. The grips are squeezed toward each other to open the jaws, enabling the user to mount the spring clip over a portion of bag 14 at the top of rack 12. With the spring clip so mounted over both the bag and the rack, the grips are released. Spring 122 then closes the jaws about the combination of the bag material and the rack material, as shown in FIG. 23, thus trapping the bag material between jaws 116 and the rack tubing. One, or more than one, such spring clips 114 can be mounted on each side arm 60, optionally on rear arm 82, as needed to hold bag 14 stable on the rack while the bag is being filled.

Figure 24:
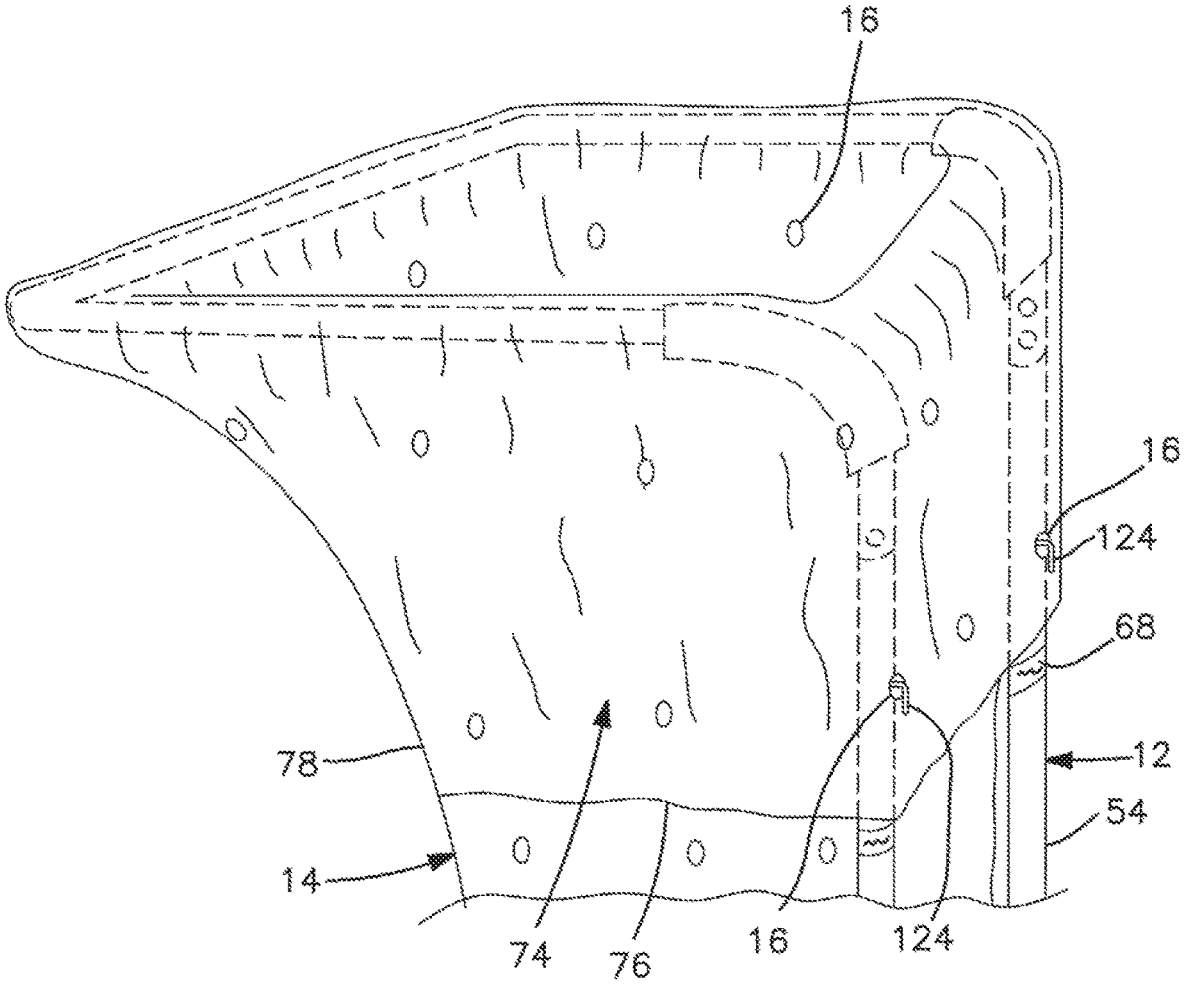
FIG. 24 is a pictorial side view of the top portion of the rack, with the bag fully installed on the rack, all as in FIG. 8, and with the top of the bag being temporarily secured to the rack, while the bag is being loaded with waste material, using hooks which extend outwardly and downwardly from the legs.

FIG. 24 shows yet another embodiment of methods for holding bag 14 stable, mounted on the rack while the bag is being filled. In FIG. 24, a hook 124 extends outwardly and down from each rack leg 54. When the bag is mounted to the rack, the bag is passed over the hook 124 at a hole 16 in the top portion 74 of the bag which is disposed outwardly of the rack tubing such that the hook extends through the hole, and terminates in a downwardly-extending hook leg. As waste material is placed in/added to bag 14, the weight of the waste material pulls downwardly on that portion of the bag sidewall which is inside the rack. Such downward pull on that portion of the bag sidewall which is inside the rack translates to an upward pull on that portion of the bag sidewall, namely the upper portion of the bag, which is outside the rack. That upward pull is applied at hooks 124 whereby the greater the downward pull on the bag sidewall inside the rack, the greater the upward pull on the bag sidewall at hooks 124. The greater such upward pull at hooks 124, the greater the stability of the bag on the rack while the bag is being filled with waste material.

Holes 16 in the bag enable air to escape through the side walls and end walls of the bag while the bag, or bags, is/are being compressed during compaction in the baler. Because the air can easily escape from the bag, through the holes in the bag side walls and end wall during baling, a greater fraction of the air can be removed from the bag for a given compaction force whereby a bale of such) e.g. plastic film, can contain about 10% to about 25% more weight/mass of the film or other thin-section waste material than a traditional bale made with the same baler conditions, without use of the invention. Because a bale made according to the invention has more mass, and fewer bales are needed for disposing of a given mass of waste material. Fewer bales means relatively less labor cost, greater waste material weight per truckload shipped to a recycling center, thus fewer truckloads and associated relatively lower shipping cost. In addition to the greater efficiency in weight capacity enabled by this invention, workers no longer need to bend, lift, and twist hundreds of times to retrieve loosely-arranged pieces of e.g. plastics film from the bulk box and place them into the baler, thus improving the ergonomics of the work environment by reducing the risk of repetitive motion injury.

As used herein, recyclable materials being loaded into the bag can include such materials as shrink wrap, foam, and bubble wrap, which are typically LDPE, medical blue wrap which is typically polypropylene (PP), material used for banding, which may be e.g. PP or polyethylene terephthalate (PET), paper, styrofoam/polystyrene, laminates of various plastics and plastic/paper composites. Other materials, typically low bulk density materials, which trap or contain large quantities of air, can be placed in the bag and still fall within the scope of this invention.

Having thus described the invention, what is claimed is:

1. In combination, a rack adapted and configured to hold a bag, and a bag adapted and configured to be held on the rack while waste material is being placed in the bag, the rack comprising:

a base section having a front-to-back length perpendicular to a side-to-side width;

an upper section that includes a first side arm, a second side arm, and a rear arm, the first and second side arms disposed opposite each other and connected to the rear arm so as to a U-shape, the U-shape defining a gap between a first proximal end of the first side arm and a second proximal end of the second side arm, the first side arm defining a front-to-back length of the upper section, and the rear arm defining a side-to-side width of the upper section;

a first leg and a second leg supporting the upper section from the base section, the first leg extending from the base section to the first proximal end of the first side arm, and the second leg extending from the base section to the second proximal end of the second side arm; and a first rack elbow and a second rack elbow, the first rack elbow formed at a junction of the first leg with the first side arm, and the second rack elbow formed at a junction of the second leg with the second side arm; and the bag having at least a 40-gallon US capacity when installed on the rack, the bag having a top edge, a bottom edge, and a side wall extending from the top edge to the bottom edge, a length of the bag generally extending along the side wall from the top edge to the bottom edge, the bag being closed at or adjacent the bottom edge, the bag being open about a circumference of the bag at the top edge, thereby to define the bag as an open-top, closed-bottom receptacle suitable for receiving thin-section sheet material when mounted on the rack, and the bag also having an array of holes distributed about the circumference of the bag, and extending along at least sixty percent of the length of the bag, the holes being effective to facilitate escape of air from the bag during compression of the bag when the bag is filled with waste sheet material;

wherein (a) the length of the base section of the rack is greater than the length of the upper section of the rack, or (b) the width of the base section of the rack is greater than the width of the upper section of the rack, or both (a) and (b);

wherein the bag comprises a stretchable material and the circumference of the bag is sized to require stretching to fit the bag over and around the upper section of the rack in order to mount the bag on the rack, and when so mounted, the bag forms a throat below the upper section and flares outwardly from the throat to the rear arm of the upper section; and wherein the array of holes defines a hole fraction of 0.05% to 1% of a surface area of the side wall of the bag.

2. In combination, a rack adapted and configured to hold a bag, and a bag adapted and configured to be held on the rack while waste material is being placed in the bag, the rack comprising:

a base section having a front-to-back length perpendicular to a side-to-side width:

an upper section that includes a first side arm, a second side arm, and a rear arm, the first and second side arms disposed opposite each other and connected to the rear arm so as to form a U-shape, the U-shape defining a gap between a first proximal end of the first side arm and a second proximal end of the second side arm, the first side arm defining a front-to-back length of the upper section, and the rear arm defining a side-to-side width of the upper section;

a first leg and a second leg supporting the upper section from the base section, the first leg extending from the base section to the first proximal end of the first side arm, and the second leg extending from the base section to the second proximal end of the second side arm; and a first rack elbow and a second rack elbow, the first rack elbow formed at a junction of the first leg with the first side arm, and the second rack elbow formed at a junction of the second leg with the second side arm; and the bag having at least a 40-gallon US capacity when installed on the rack, the bag having a top edge, a bottom edge, and a side wall extending from the top edge to the bottom edge, a length of the bag generally extending along the side wall from the top edge to the bottom edge the bag being closed at or adjacent the bottom edge, the bag being open about a circumference of the bats at the top edge, thereby to define the bag as an open-top, closed-bottom receptacle suitable for receiving thin-section sheet material when mounted on the rack, and the bag also having an array of holes distributed about the circumference of the bag, and extending along at least sixty percent of the length of the bag, the holes being effective to facilitate escape of air from the bag during compression of the bag when the ban is filled with waste sheet material;

wherein (a) the length of the base section of the rack is greater than the length, of the upper section of the rack, or (b) the width of the base section of the rack is greater than the width of the upper section of the rack, or both (a) and (b);

wherein the ba comprises a stretchable material and the circumference of the bag is sized to require stretching to fit the bag over and around the upper section of the rack in order to mount the bag on the rack and when so mounted, the bag forms a throat below the upper section and flares outwardly from the throat to the rear arm of the upper section; and wherein the array of holes defines a hole fraction of 0.07% to 0.5% of a surface area of the sidewall of the bag.

3. In combination, a rack adapted and configured to hold a bag and a bag adapted and configured to be held on the rack while waste material is being placed in the bag, the rack comprising:

a base section having a front-to-back length perpendicular to a side-to-side width;

an upper section that includes a first side arm, a second side arm, and a rear arm, the first and second side arms disposed opposite each other and connected to the rear arm so as to form a U-shape, the U-shape defining a gap between a first proximal end of the first side arm and a second proximal end of the second side arm, the first side arm defining a front-to-back length of the upper section, and the rear arm defining a side-to-side width of the upper section;

a first leg and a second leg supporting the upper section from the base section, the first leg extending from the base section to the first proximal end of the first side arm, and the second leg extending from the base section to the second proximal end of the second side arm; and a first rack elbow and a second rack elbow, the first rack elbow formed at a junction of the first leg with the first side arm, and the second rack elbow formed at a junction of the second leg with the second side arm; and the bag having at least a 40-gallon US capacity when installed on the rack, the bag having a top edge, a bottom edge, and a side wall extending from the top edge to the bottom edge, a length of the bag generally extending along the side wall from the top edge to the bottom edge, the bag being closed at or adjacent the bottom edge, the ban being open about a circumference of the bag at the top edge, thereby to define the bag as an open-top, closed-bottom receptacle suitable for receiving thin-section sheet material when mounted on the rack, and the bag also having an array of holes distributed about the circumference of the bag, and extending along at least sixty percent of the length of the bag, the holes being effective to facilitate escape of air from the bag during compression of the bag when the bag when the bag is filled with waste sheet material;

wherein (a) the length of the base section of the rack is greater than the length of the upper section of the rack or (b) the width of the base section of the rack is greater than the width of the upper section of the rack, or both (a) and (b);

wherein the bag comprises a stretchable material and the circumference of the ban is sized to require stretching to fit the bag over and around the upper section of the rack in order to mount the bag on the rack, and when so mounted, the bag forms a throat below the upper section and flares outwardly from the throat to the rear arm of the upper section; and wherein the array of holes defines a hole fraction of 0.07% to 0.25% of a surface area of the side wall of the bag.

4. The combination of claim 3, wherein the holes in the array of holes are spaced apart by an average of at least 3 inches.

5. The combination of claim 3, wherein the holes in the array of holes are spaced apart by an average of at least 4 inches.

6. The combination of claim 3, wherein an average open area of the holes in the array of boles corresponds to an area of a round hole having a diameter of at least 0.18 inch.

7. The combination of claim 3, wherein an average open area of the holes in the array corresponds to an area of a round hole having a diameter of about 0.38 inch.

8. In combination, a rack adapted and configured to hold a bag, and a bag adapted and configured to be held on the rack while waste material is being placed in the bag, the rack comprising:

a base section having a front-to-back length perpendicular to a side-to-side width;

an upper section that includes a first side arm, a second side arm, and a rear arm, the first and second side arms disposed opposite each other and connected to the rear arm so as to form a U-shape, the U-shape defining a gap between a first proximal end of the first side arm and a second proximal end of the second side arm, the first side arm defining a front-to-back length of the upper section, and the rear arm defining a side-to-side width of the upper section;

a first leg and a second leg supporting the upper section from the base section, the first leg extending from the base section to the first proximal end of the first side arm, and the second lea extending from the base section to the second proximal end of the second side arm; and a first rack elbow and a second rack elbow, the first rack elbow formed at a junction of the first leg with the first side arm, and the second rack elbow formed at a junction of the second leg with the second side arm; and the bag having at least a 40-gallon US capacity when installed on the rack, the bag having, a top edge, a bottom edge, and a side wall extending from the top edge to the bottom edge, a length of the bag generally extending along the side wall from the top edge to the bottom edge, the bag being closed at or adjacent the bottom edge, the bag being open about a circumference of the bag at the top edge, thereby to define the bag as an open-top, closed-bottom receptacle suitable for receiving thin-section sheet material when mounted on the rack, and the hag also having an array of holes distributed about the circumference of the bag, and extending along, at least sixty percent of the length of the bag, the holes being effective to facilitate escape of air from the bag during compression of the ban when the bag is filled with waste sheet material;

wherein (a) the length of the base section of the rack is greater than the length of the upper section of the rack, or (b) the width of the base section of the rack is greater than the width of the upper section of the rack, or both (a) and (b);

wherein the bag comprises a stretchable material and the circumference of the bag is sized to require stretching to fit the bag over and around the upper section of the rack in order to mount the ban on the rack, and when so mounted, the bag forms a throat below the upper section and flares outwardly from the throat to the rear arm of the upper section; and wherein the holes in the array of holes are arranged randomly.

9. In combination, a rack adapted and configured to hold a bag, and a bag adapted and configured to be held on the rack while waste material is being placed in the bag, the rack comprising:

a base section having a front-to-back length perpendicular to a side-to-side width;

an upper section that includes a first side arm, a second side arm, and a rear arm, the first and second side arms disposed opposite each other and connected to the rear arm so as to form a U-shape, the U-shape defining a gap between a first proximal end of the first side arm and a second proximal end of the second side arm, the first side arm defining a front-to-back length of the upper section, and the rear arm defining a side-to-side width of the upper section;

a first leg and a second leg supporting the upper section from the base section, the first leg extending from the base section to the first proximal end of the first side arm, and the second leg extending from the base section to the second proximal end of the second side arm; and a first rack elbow and a second rack elbow, the first rack elbow formed at a junction of the first leg with the first side arm, and the second rack elbow formed at a junction of the second leg with the second side arm; and the bag having at least a 40-gallon US capacity when installed on the rack, the bag having a top edge, a bottom edge, and a side wall extending from the top edge to the bottom edge, a length of the bag generally extending along the side wall from the top edge to the bottom edge, the bag being closed at or adjacent the bottom edge, the bag being open about a circumference of the bag at the top edge, thereby to define the bag its an open-top, closed-bottom receptacle suitable for receiving thin-section sheet material when mounted on the rack, and the bag also having an array of holes distributed about the circumference of the bag, and extending along at least sixty percent of the length of the bag, the holes being effective to facilitate escape of air from the bag during compression of the bag when the bag is filled with waste sheet material;

wherein (a) the length of the base section of the rack is greater than the length of the upper section of the rack, or (b) the width of the base section of the rack is greater than the width of the upper section of the rack, or both (a) and (b);

wherein the bag comprises a stretchable material and the circumference of the bag is sized to require stretching to fit the bag over and around the upper section of the rack in order to mount the bag on the rack, and when so mounted, the bag forms a throat below the upper section and flares outwardly from the throat to the rear arm of the upper section; and wherein the bag comprises hanging chads at the holes.

* * * * *